US007602361B2

(12) United States Patent
Aoki

(10) Patent No.: US 7,602,361 B2
(45) Date of Patent: Oct. 13, 2009

(54) ELECTRO-OPTICAL DEVICE, DRIVING CIRCUIT, METHOD, AND APPARATUS TO CLEAR RESIDUAL IMAGES BETWEEN FRAMES AND PRECHARGE VOLTAGE FOR SUBSEQUENT OPERATION

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 673 days.

(21) Appl. No.: 11/039,811

(22) Filed: Jan. 24, 2005

(65) Prior Publication Data

US 2005/0162448 A1 Jul. 28, 2005

(30) Foreign Application Priority Data

Jan. 28, 2004 (JP) ..... 2004-020099
Dec. 24, 2004 (JP) ..... 2004-372740

(51) Int. Cl.
*G09G 5/10* (2006.01)

(52) U.S. Cl. ..... 345/89; 345/690

(58) Field of Classification Search ..... 345/55, 345/76, 77, 87–100, 204, 690
See application file for complete search history.

(56) References Cited

U.S. PATENT DOCUMENTS 4,412,251 A * 10/1983 Tanaka et al. ..... 348/571
5,546,341 A * 8/1996 Suh et al. ..... 365/185.33
6,150,766 A * 11/2000 Shino et al. ..... 315/169.4
6,831,622 B2 * 12/2004 Aoki ..... 345/87
7,027,018 B2 4/2006 Nitta et al.
7,030,851 B2 4/2006 Yamazaki et al.
2001/0011983 A1 * 8/2001 Shiraki et al. ..... 345/92
2003/0011696 A1 * 1/2003 Yamazaki ..... 348/312
2003/0151564 A1 * 8/2003 Yamashita et al. ..... 345/52
2005/0104829 A1 * 5/2005 Aoki ..... 345/89
2005/0156820 A1 * 7/2005 Aoki ..... 345/58

FOREIGN PATENT DOCUMENTS

CN 1445738 A 10/2003
JP A-2002-169515 6/2002
JP A-2002-229004 8/2002
JP A-2002-351427 12/2002
JP A-2003-022058 1/2003
JP A-2003-140619 5/2003

* cited by examiner

*Primary Examiner*—Amare Mengistu
*Assistant Examiner*—Vinh T Lam
(74) *Attorney, Agent, or Firm*—Oliff & Berridge, PLC

(57) ABSTRACT

To improve the display quality of a moving picture by performing a hold-type display of a liquid crystal, etc. using an impulse-type response. A selection voltage is applied to a selected scanning line during an effective horizontal scan period, and a voltage corresponding to the brightness of a pixel corresponding to an intersection with the selected scanning line is applied to one data line. During a horizontal flyback period when another scanning line is selected, a selection voltage is applied to the selected scanning line and a voltage allowing the pixel to display black as the least brightness is applied to the data line. As a result, the display of the pixel is erased and the data lines are precharged with the voltage erasing the display, for preparation of the subsequent writing operation.

13 Claims, 15 Drawing Sheets

ELECTRO-OPTICAL DEVICE, DRIVING CIRCUIT, METHOD, AND APPARATUS TO CLEAR RESIDUAL IMAGES BETWEEN FRAMES AND PRECHARGE VOLTAGE FOR SUBSEQUENT OPERATION

BACKGROUND

The present invention relates to an electro-optical device suitable for displaying, for example, a moving picture, a driving circuit of the electro-optical device, a driving method of the electro-optical device, and an electronic apparatus.

Recently, as display devices taking place of cathode ray tubes (CRT), electro-optical devices performing a display on the basis of electro-optical change of a liquid crystal, etc. have been widely used for various electronic apparatuses, televisions, etc. because of advantageous features such as decrease in thickness, size, and power consumption.

By their driving methods, the electro-optical devices can be roughly classified into an active matrix electro-optical device group in which pixels are driven using switching elements and a passive matrix electro-optical device group in which pixels are driven without using switching elements. Since the pixels are separated by the switching elements, the display quality of the active matrix electro-optical devices belonging to the former group is considered to be more excellent than that of the passive matrix electro-optical devices belonging to the former group.

In such matrix electro-optical devices, voltages corresponding to gray scales are written in a frame (vertical scan period) and the voltages are retained till the next frame. Therefore, it can be observed that the pixel retains the same display state during a period from a frame to a next frame (a vertical scan period).

As a result, when a moving picture is displayed, it is easy to recognize residual images with naked eyes because the same display state is retained during at least one vertical scan period. Therefore, a problem of poor display quality comes up.

Accordingly, exemplary techniques for preventing the residual images can include the technique by which the display quality of a moving picture is improved by providing a non-display field between a frame and the next frame and making the display close to an impulse-type display, the technique by which impulse-type display light is obtained by selecting the scanning lines in each frame two times, writing display signals at the first selection, and writing black-level signals at the second selection for the same time period as at the first selection, etc.

SUMMARY

However, the above-mentioned techniques can improve the display quality of a moving picture due to the impulse-type display, but have a defect of requiring a fast writing operation. This is because in the technique by which the non-display field is provided between a frame and the next frame, a time period for scanning is shortened by the non-display field. Further, this is also because in the technique by which the display signals are written and then the black-level signals are written for the same time, the scanning lines should be selected two times and the time period for writing the display signals is reduced by half.

The present invention is contrived to solve the aforementioned problems, and it is an object of the present invention to provide an electro-optical device in which an impulse-type display suitable for displaying a moving picture can be realized without requiring a fast writing operation, a driving circuit of the electro-optical device, a driving method of the electro-optical device, and an electronic apparatus.

In order to accomplish the object, according to an aspect of the present invention, there is provided A driving circuit of an electro-optical device for driving pixels arranged to correspond to intersections between a plurality of scanning lines and a plurality of data lines, the driving circuit comprising: a scanning-line driving circuit that selects a first scanning line of the plurality of scanning lines and supplies a selection signal to the first scanning line during a first effective horizontal scan period of the first horizontal scan period, and that supplies a scan signal to the first scanning line during all or a part of a horizontal flyback period after the first horizontal scan period; and a data-line driving circuit that, during the first effective horizontal scan period, supplies the pixels corresponding to the intersections with the selected scanning line with an image signal corresponding to a brightness to be displayed and that, during all or a part of the horizontal flyback period, supplies the pixels with an image signal for displaying at, or nearly at, a minimum brightness. According to the driving circuit described above, the pixels retains the voltage of the data lines during the effective horizontal scan period so as to display the brightness corresponding to the voltage, and then displays the least brightness (or a brightness close to the least brightness) due to the voltage applied to the data lines during the horizontal flyback period. As a result, since the pixels stay in the display state from the time point when the scanning line which the pixels belong to is selected during the effective horizontal scan period to the time point when the selection voltage is applied again to the pixels during the horizontal flyback period of the horizontal scan period when another scanning lines is selected, the residual image is prevented in displaying a moving picture. Since the horizontal flyback period is still shorter than the effective horizontal scan period, the effective horizontal scan period for applying the voltage corresponding to the original brightness to the pixels is not reduced. Accordingly, the fast writing operation is not required. Furthermore, since the data lines are precharged in advance to the voltage corresponding to the least brightness during the horizontal flyback period before voltages corresponding to brightness are applied to the data lines during the effective horizontal scan period, the influence of the remaining voltage due to parasitic capacitance can be reduced. In order to remove the display of the pixels during the flyback period, the pixels may be made to display the least brightness or the brightness close to the least brightness (a color close to black).

In the driving circuit described above, each pixel may have a pixel electrode and a counter electrode opposing the pixel electrode, and the data-line driving circuit may alternately supply one data line with a negative voltage lower and a positive voltage higher than a voltage applied to the common electrode every horizontal scan period.

When the negative voltage and the positive voltage are alternately applied every horizontal scan period, the scanning-line driving circuit may supply a scan signal to the first scanning line during the effective horizontal scan period and may then supply again the selection voltage to the first scanning line during all or a part of the horizontal flyback period right before selecting an even-numbered scanning line. According to the construction described above, since the voltage corresponding to the least brightness (or a brightness close to the least brightness) during the horizontal flyback period has the same polarity as does the voltage during the effective horizontal scan period, the writing load using the data lines is reduced.

In the present invention, a driving method of an electro-optical device may be embodied, as well as the driving circuit of an electro-optical device. In this driving method, the selection voltage may be applied to the first scanning line during all or a part of the horizontal flyback period, and the data lines may be precharged with a predetermined voltage after the voltage making the pixels display the least brightness or the brightness close to the least brightness is applied to the data line and before the effective horizontal scan period. As a result, the data line can be precharged with a voltage different from the voltage making the pixels display the least brightness.

The present invention may provide an electro-optical device itself. In an electronic apparatus according to the present invention, since the electro-optical device is provided as a display unit, it is possible to prevent the residual image when displaying a moving picture.

DETAILED DESCRIPTION OF EMBODIMENTS

Hereinafter, embodiments of the present invention will be described with reference to the drawings.

First Embodiment

Figure 1:
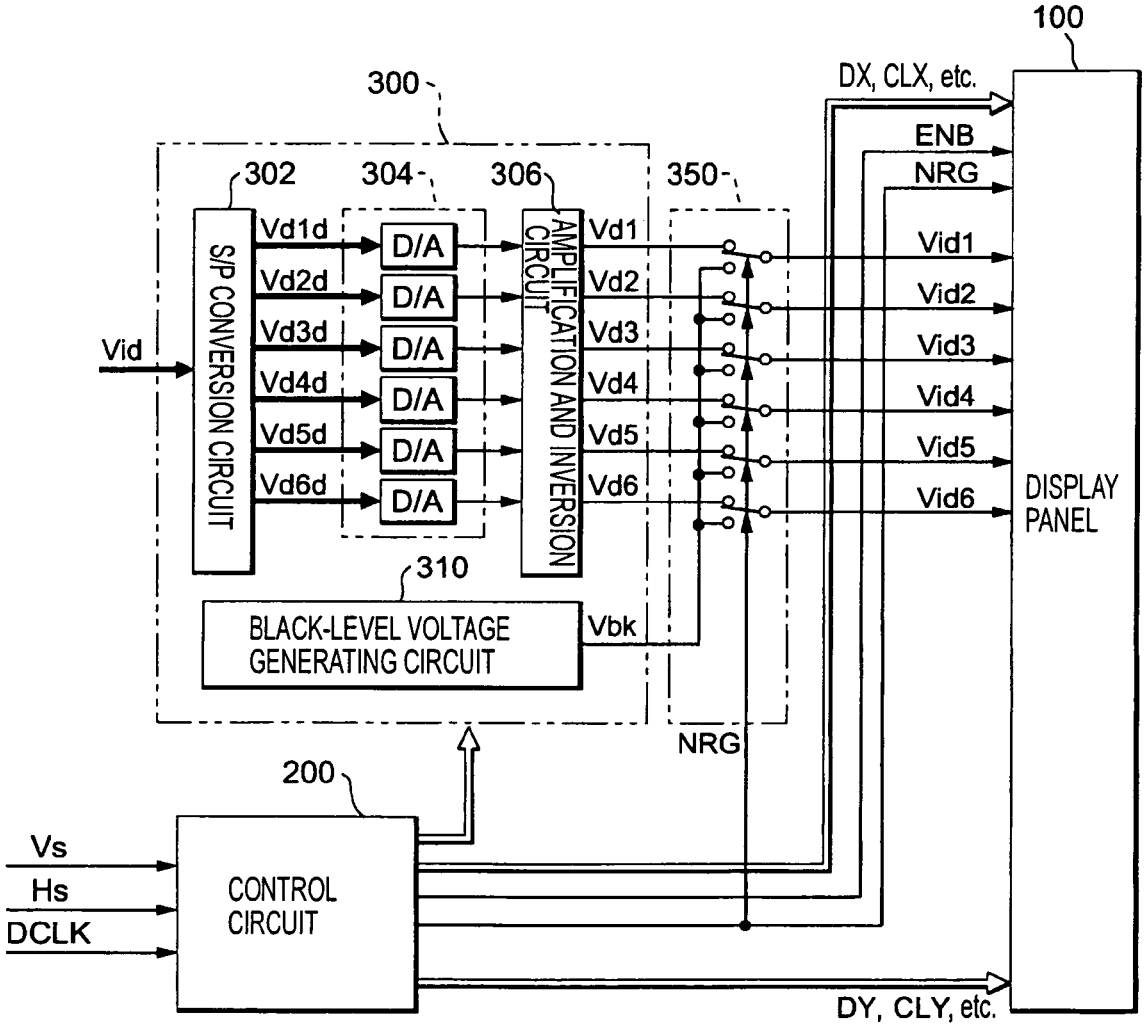
FIG. 1 is a block diagram illustrating the whole structure of an electro-optical device according to a first embodiment of the present invention.

FIG. 1 is a block diagram illustrating a structure of an electro-optical device according to a first embodiment of the present invention.

As shown in the figure, the electro-optical device comprises a display panel 100, a control circuit 200, a processing circuit 300, and a selector 350. The control circuit 200 generates timing signals, clock signals, etc. for controlling respective elements, in accordance with a vertical scan signal Vs, a horizontal scan signal Hs, and a dot clock signal DCLK supplied from upper-level units not shown.

The processing circuit 300 comprises an S/P conversion circuit 302, a D/A converter group 304, an amplification and inversion circuit 306, and a black-level voltage generating circuit 310.

The S/P conversion circuit 302 distributes image data Vid into N channels (N=6 in the figure), enlarges the image data six times on the temporal axis (serial-to-parallel conversion), and then outputs the expanded image data as image data Vd1*d* to Vd6*d*. The image data Vid are supplied in series from an upper-level unit not shown in synchronization with the vertical scan signal Vs, the horizontal scan signal Hs, and the dot clock signal DCLK, that is, in synchronization with the vertical scanning and the horizontal scanning, and specify a digital value for brightness (gray scale) of each pixel. Here, the reason for serial-parallel converting the image signals is to elongate the time when image signals are applied through sampling switches 151 (see FIG. 2) and to secure sample-and-hold time and charging and discharging time.

In the D/A converter group 304, a D/A converter is provided in each channel, and the image data Vd1*d* to Vd6*d* are converted into analog image signals having voltages corresponding to gray scales of pixels.

The amplification and inversion circuit 306 polarity-inverts or normally rotate the analog image signals, properly amplifies the image signals, and then supplies the amplified image signals as image signals Vd1 to Vd6. Here, the inversion of polarity may be performed (1) every scanning line, (2) every data signal line, (3) every pixel, and (4) every screen (frame), but for the purpose of convenient explanation in the present embodiment, the mode of performing the inversion of polarity (1) every scanning line is exemplified. However, it is not intended to limit the present invention to this mode. In the present embodiment, the inversion of polarity means that the voltage level is alternately inverted about a predetermined constant voltage Vc (which is an amplitude-center potential of the image signals and which is approximately equal to the voltage LCcom applied to the counter electrode). In the present embodiment, a voltage higher than the voltage Vc is referred to as a positive polarity and a voltage lower than the voltage Vc is referred to as a negative polarity.

In the present embodiment, the image data Vd1*d* to Vd6*d* converted by the S/P conversion circuit 302 are converted into analog signals, but the analog conversion of the image data may be performed after digitally amplifying and inverting the image data.

The black-level voltage generating circuit 310 generates a voltage signal Vbk making the pixels to display black, which is the least brightness, as a precharge voltage of the data lines. Here, in the present embodiment, in a case of the normally-white mode where the pixels of the display panel 100 display white which is the highest brightness in a state where no voltage is applied, the black-level voltage generating circuit 310 generates a voltage signal Vbk shown in FIG. 6. That is, the black-level voltage generating circuit 310 outputs a positive black voltage Vbk (+) during a horizontal flyback period of a horizontal scan period when a positive writing operation is performed, and outputs a negative black voltage Vbk (−) during a horizontal flyback period of the horizontal scan period when a negative writing operation is performed. As described above, in the present embodiment, since the inversion of polarity is performed every scanning line, the writing polarity is inverted every horizontal scan period. The black-level voltage generating circuit 310 inverts the voltage signal Vbk every horizontal scan period with the inversion of polarity.

Referring to FIG. 1 again, the selector 350 selects the image signals Vd1 to Vd6 from the amplification and inversion circuit 306, for example, when the signal NRG (which is a selection signal of the selector 350 and is a precharge control signal) has an L level in the respective channels, and selects the voltage signal Vbk from the black-level voltage generating circuit 310 when the signal NRG has an H level, thereby supplying the selected signals as the signals Vid1 to Vid6 to the display panel 100. Here, the signal NRG is a signal which is supplied from the control circuit 200 and is changed to the H level during the horizontal flyback period.

Figure 2:
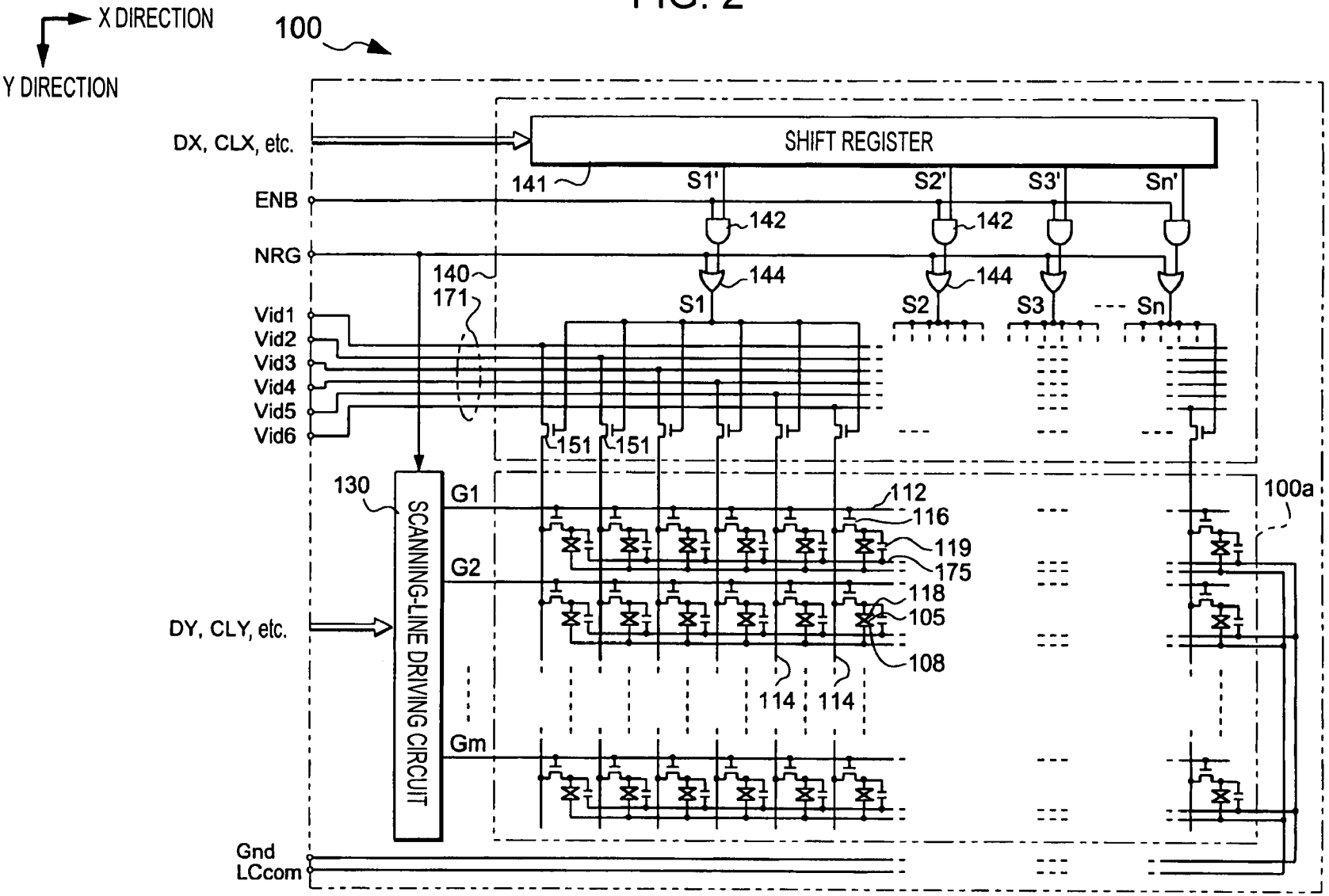
FIG. 2 is a block diagram illustrating a structure of a display panel in the electro-optical device.

Next, a detailed structure of the display panel 100 will be described. FIG. 2 is a block diagram illustrating an electrical structure of the display panel 100. The display panel 100 has a structure that an element substrate and a counter substrate formed with a counter electrode are bonded to each other with a constant gap therebetween and that a liquid crystal is sealed in the gap.

As shown in FIG. 2, in the element substrate, a plurality of scanning lines 112 is formed to extend in the X direction in a display area 100*a* and a plurality of data lines 114 is formed to extend in the Y direction. A pair of a thin film transistor (hereinafter, referred to as "TFT") 116 and a pixel electrode 118 is provided at each intersection between the scanning lines 112 and the data lines 114. Here, the gate of the TFT 116 is connected to the corresponding scanning line, the source is connected to the corresponding data line 114, and the drain is connected to the pixel electrode 118.

The counter electrode 108 having a constant voltage LCcom is provided to oppose the pixel electrode 118, and a liquid crystal layer 105 is interposed between the pixel electrode 118 and the counter electrode 108. As a result, a liquid crystal capacitor having the pixel electrode 118, the counter electrode 108, and the liquid crystal layer 105 is constructed in each pixel.

The opposing surfaces of both substrates are provided with alignment films (not shown) having been subjected to a rubbing process such that the major axis direction of liquid crystal molecules is continuously twisted, for example, by about 90° between both substrates, while the rear surfaces of both substrates are provided with polarizers corresponding to the alignment directions, respectively. In addition, a storage capacitor 119 is formed at each pixel so as to prevent electric charges from being leaked from the liquid crystal capacitor. One end of the storage capacitor 119 is connected to the pixel electrode 118 (the drain of the TFT 116) and the other end is connected in common to a potential Gnd 175 in all pixels. In the present embodiment, the other end of the storage capacitor 119 is connected to a potential Gnd 175, but it is sufficient only if it is connected to a constant potential (such as the voltage LCcom, the high-potential source voltage of the driving circuit, the low-potential source voltage, etc.).

Here, for the purpose of convenient explanation, supposed that the total number of scanning lines 112 is "m" and the total number of data lines 114 is "6n" (where m and n are integers), the pixels are arranged in a matrix shape of m rows×6n columns at the respective intersections between the scanning lines 112 and the data lines 114.

Light passing between the pixel electrodes 118 and the counter electrode 108 is optically rotated by about 90° depending upon degrees of twist of liquid crystal molecules when an effective voltage value of a liquid crystal capacitor is zero, while the liquid crystal molecules are inclined in an electric-field direction with increase of the effective voltage value, so that the optical rotation disappears. As a result, for example, in a transmissive liquid crystal panel, in a case of the normally-white mode in which the polarizers of which polarizing axes are perpendicular to each other are disposed correspondingly to an alignment direction at the incident side and the rear-surface side, respectively, when the effective voltage value of the liquid crystal capacitor is zero, the light is transmitted and thus a white color is displayed (the transmittance or brightness is in maximized), while the quantity of light to be transmitted is decreased with increase of the effective voltage value and thus a black color is displayed (the transmittance or brightness is minimized).

On the other hand, a scanning-line driving circuit 130, a data-line driving circuit 140, etc. are provided around the display area 100*a*. Among these, the scanning-line driving circuit 130 outputs scan signals G1, G2, . . . , Gm which exclusively become an active level during an effective horizontal display period and during a horizontal flyback period thereafter, and details thereof will be described later.

Figure 5:
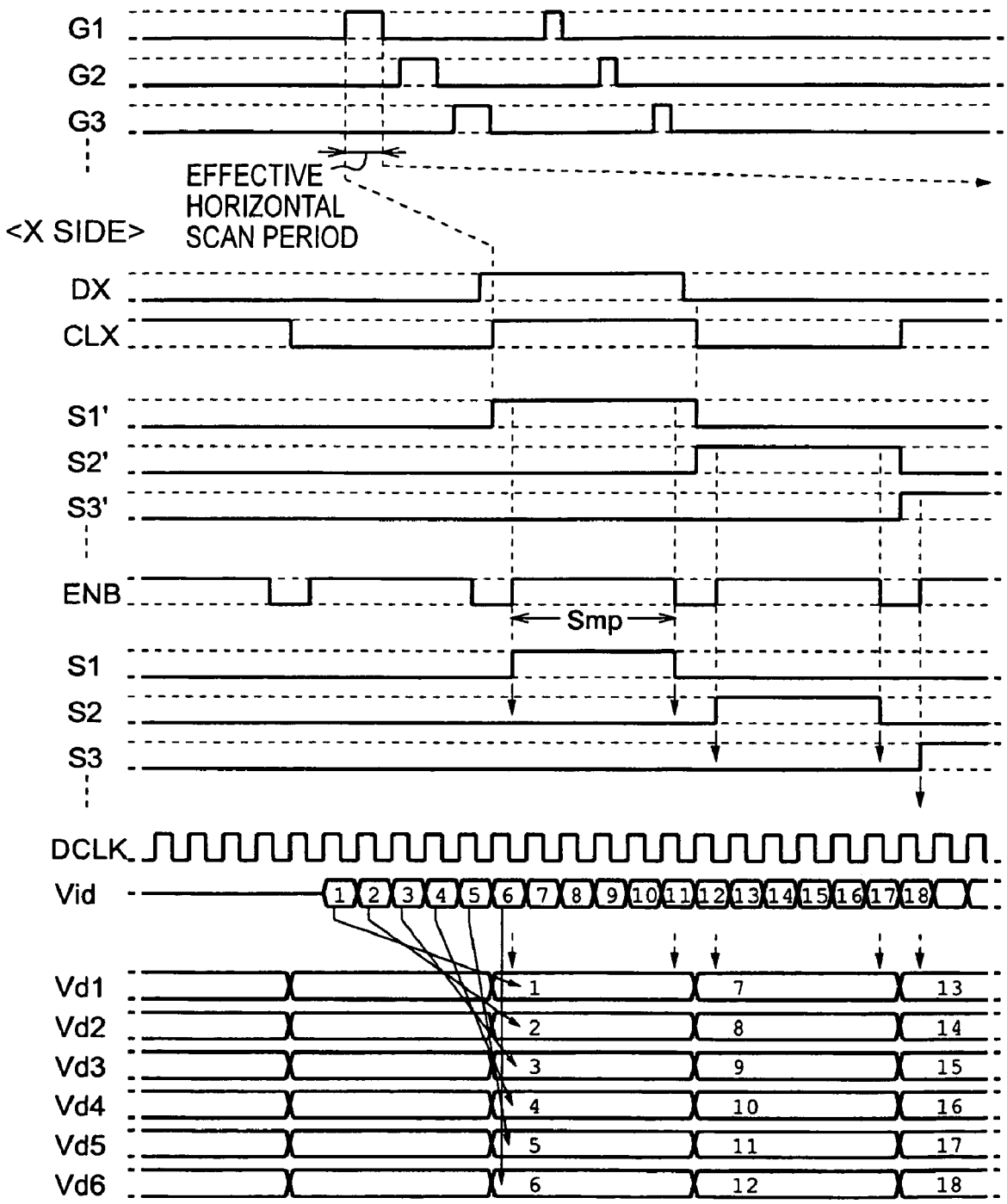
FIG. 5 is a timing chart explaining operations of the electro-optical device.

The data-line driving circuit 140 comprises a shift register 141, AND circuits 142, OR circuits 144, and sampling switches 151. As shown in FIG. 5, the shift register 141 sequentially shifts the transmission start pulse DX supplied at the time of start of an effective horizontal scan period whenever the level of the clock signal CLX is changed (rises or drops) and outputs the shifted clock signals as signals S1', S2', S3', . . . , Sn' to correspond to the respective groups of data lines.

The AND circuit 142 is provided at the respective output terminals of the shift registers 141 and outputs a logical product of the signal from the output terminal and the signal ENB supplied from the control circuit 200. As a result, the width of the signal from the respective output terminals of the shift register 141 is reduced into the pulse width Smp of the signal ENB, thereby preventing the adjacent widths from overlapping each other due to delay of signals.

Each OR circuit 144 outputs a logical sum of the logical product from the AND circuit 142 and the signal NRG supplied from the control circuit 200 as a sampling signal. In this way, the signals S1', S2', S3', . . . , Sn' from the shift register 141 sequentially pass through the AND circuits 142 and the OR circuits 144 and are finally output as the sampling signals S1, S2, S3, . . . , Sn.

The sampling switches 151 sample the six channel signals Vid1 to Vid6 supplied through the six image signal lines 171 into the data lines 114 in accordance with the sampling signals S1, S2, S3, . . . , Sn, and are provided in each data line 114. In the present embodiment, the data lines 114 are classified into blocks having six data lines, and the sampling switch 151 connected to one end of the data line 114 positioned at the leftmost among the six data lines 114 belonging to an i-th block (where i is 1, 2, . . . , n) from the left end of FIG. 2 samples the image signal Vid1 supplied through the image-signal line 171 during a time when the sampling signal S1 becomes active, and supplies the sampled image signal to the corresponding data line 114. The sampling switch 151 connected to one end of the data line 114 positioned at the second position from the leftmost in the block samples the image signal Vid2 during the time when the sampling signal S1 becomes active, and supplies the sampled image signal to the corresponding data line 114. Similarly, the respective sampling switches 151 connected to one ends of the data lines 114 positioned at the third, fourth, fifth, and sixth positions among the six data lines 114 belonging to the block sample the image signals Vid3, Vid4, Vid5, and Vid6 during the time when the sampling signal S1 becomes active, respectively, and supply the sampled image signals to the corresponding data lines 114.

Figure 3:
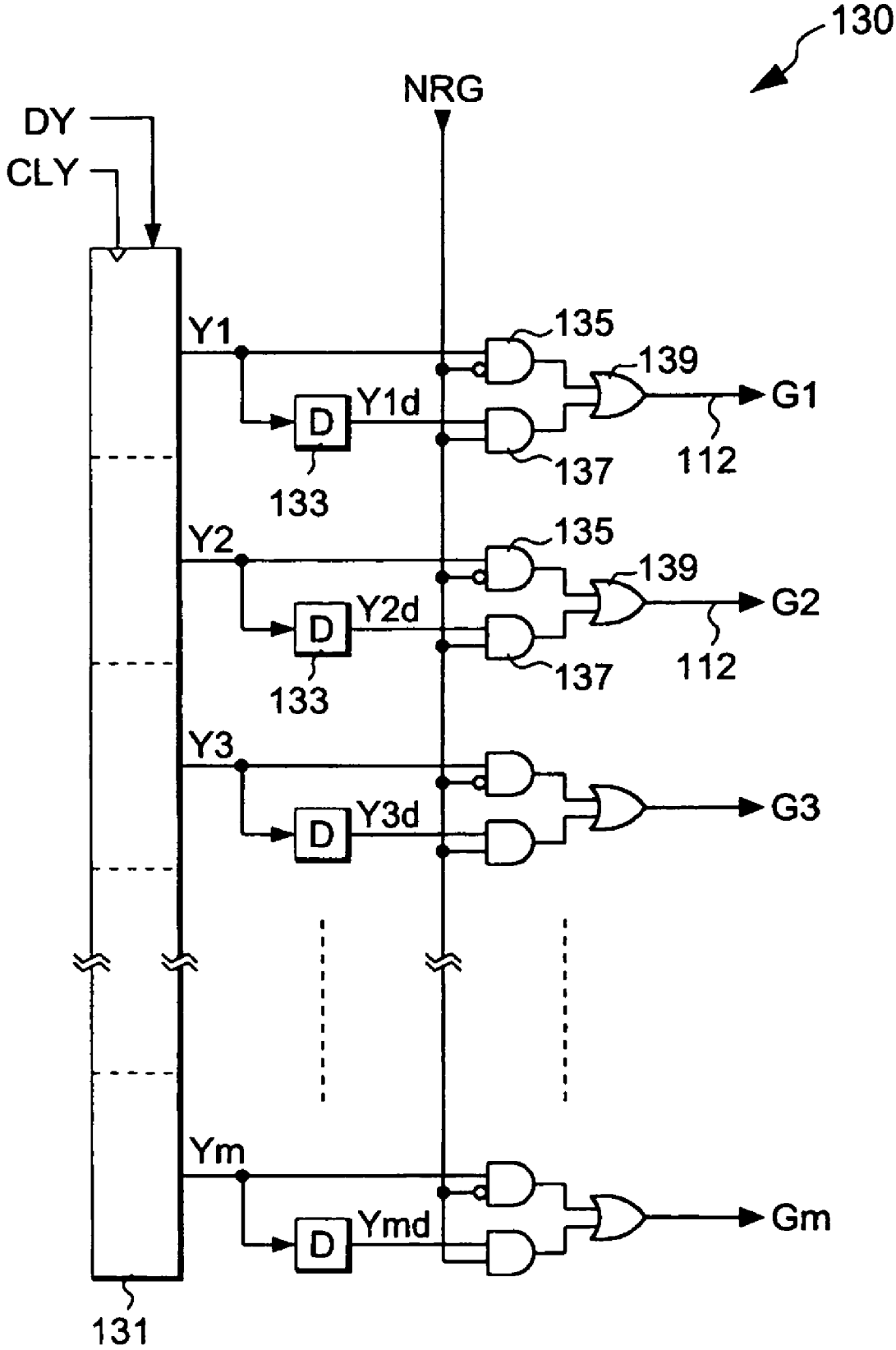
FIG. 3 is a block diagram illustrating a structure of a scanning-line driving circuit in the electro-optical device.

Next, the scanning-line driving circuit 130 will be described in detail. FIG. 3 is a block diagram illustrating a structure of the scanning-line driving circuit 130.

In the figure, a shift register 131 has m stages corresponding to the m scanning lines 112, sequentially shifts the transmission start pulse DY supplied at the time of start of one vertical scan period whenever the level of the clock signal CLY rises, and outputs the shifted pulses as signals Y1, Y2, Y3, . . . Ym.

The respective output terminals of the shift register 131 are provided with a set of a delay circuit 133, AND circuits 135 and 137, and an OR circuit 139.

Paying attention to a j-th stage (where j is one of 1, 2, . . . , m) from the uppermost in FIG. 3, the delay circuit 133 of the j-th stage delays the signal Yj and outputs the delayed signal as a delay signal Yjd. In the present embodiment, the delay time by the delay circuit 133 is four horizontal scan periods (4H).

The AND circuit 135 of the j-th stage outputs a logical product of the signal Yj and the negative signal of the signal NRG, and the AND circuit 137 of the j-th stage outputs a logical product of the delay signal Yjd and the signal NRG. The OR circuit 139 of the j-th stage calculates a logical sum of the logical products from the AND circuits 135 and 137 of the same stage and outputs the logical sum as a scan signal (selection signal) Gj to the j-th scanning line 112.

The constituent elements such as the scanning-line driving circuit 130 or the data-line driving circuit 140 are formed using the manufacturing process common to the TFTs 116, thereby contributing to decrease in size and cost of the whole device.

Figure 4:
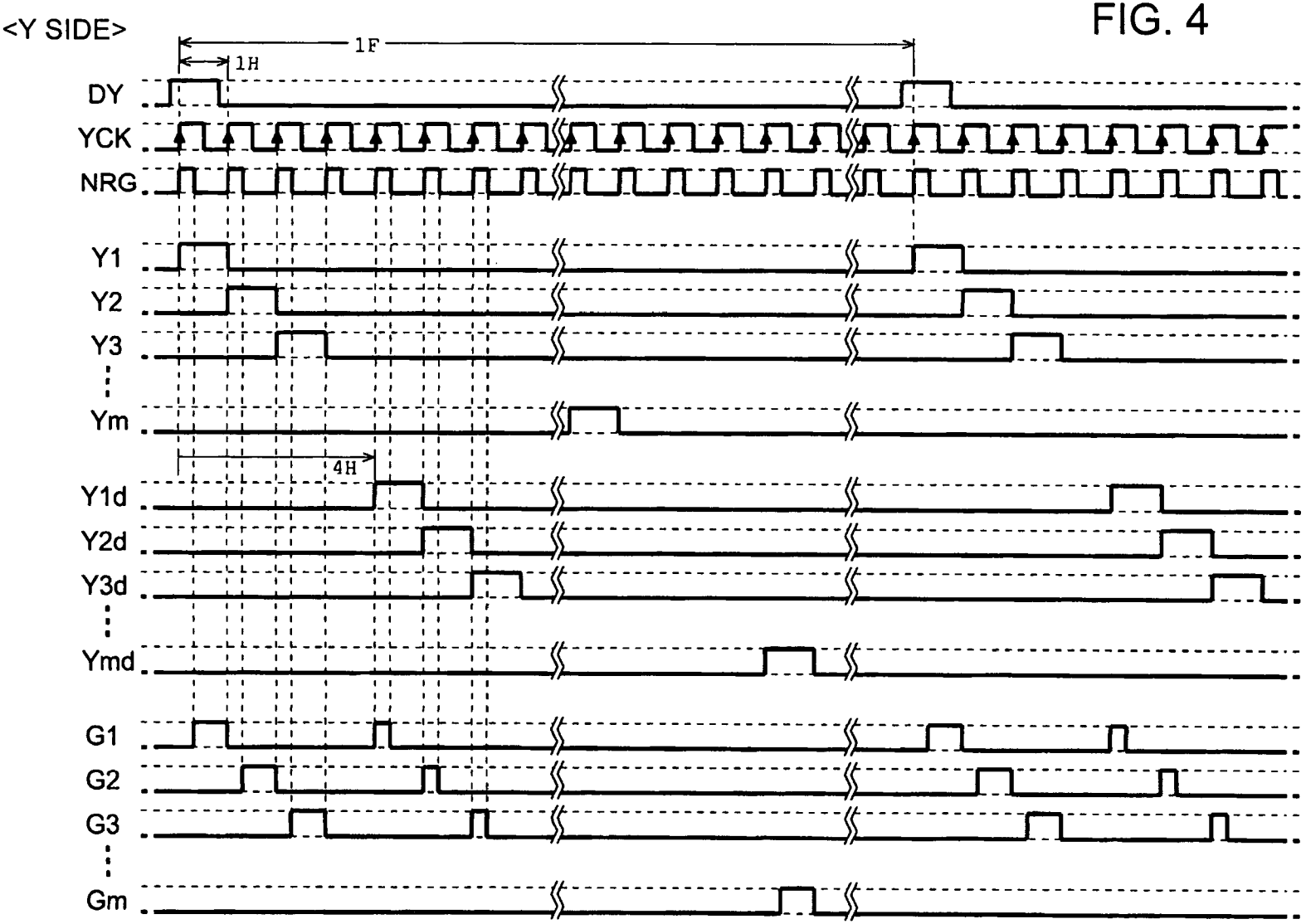
FIG. 4 is a timing chart explaining operations of the electro-optical device.

Next, operations of the electro-optical device according to the present embodiment will be described. FIGS. 4 and 5 are timing charts illustrating operations of the electro-optical device.

First, at the time of start of one vertical scan period (1F), the transmission start pulse DY is supplied to the scanning-line driving circuit 130. As shown in FIG. 4, the transmission start pulse DY is latched by the shift register 131 at the same time as the rising of a clock signal, and then is output as signals Y1, Y2, Y3, . . . , Ym.

The signals Y1, Y2, Y3, . . . , Ym are delayed by the delay circuit 133 at each stage by four horizontal scan periods (4H) and are output as delay signals Y1*d*, Y2*d*, Y3*d* . . . , Ymd.

On the other hand, the signal NRG becomes an H level during the flyback period of the horizontal scan period and becomes an L level during an effective horizontal scan period thereafter. As a result, the AND circuit 135 at each stage reduces the pulse width of the signals Y1, Y2, Y3, . . . , Ym at the H level to the effective horizontal scan period, and the AND circuit 137 at each stage reduces the pulse width of the delay signals Y1*d*, Y2*d*, Y3*d*, . . . , Ymd at the H level to the horizontal flyback period.

Therefore, at each stage, as shown in FIG. 4, the scan signals G1, G2, G3, . . . , Gm as a logical sum of the logical products from the AND circuits 135 and 137 sequentially become an H level during the effective horizontal scan period, and then sequentially become an H level again during the horizontal flyback period. In other words, for example, when the scan signal Gj supplied to the j-th scanning line 112 becomes an H level during the effective horizontal scan period, the scan signal becomes the H level again during the horizontal flyback period right before the effective horizontal scan period when the scan signal G(j+4) supplied to the (j+4)-th scanning line 112 becomes an H level. Similarly, when the scan signal G(j−4) supplied to the (j−4)-th scanning line 112 becomes an H level during the effective horizontal scan period, the scan signal becomes the H level again during the horizontal flyback period right before the effective horizontal scan period when the scan signal G(j) supplied to the j-th scanning line 112 becomes an H level.

Next, paying attention to a case where the scan signal G1 becomes an H level during the effective horizontal scan period, the signal NRG becomes an H level during the horizontal flyback period prior to the effective horizontal scan period. When the signal NRG becomes the H level, the selector 350 (see FIG. 1) selects the voltage signal Vbk. Accordingly, assuming that the writing polarity is positive during the next effective horizontal scan period, the six image signal lines 171 (see FIG. 2) becomes the voltage Vbk (+). When the signal NRG becomes the H level, the logical product to the OR circuit 144 becomes an H level regardless of the logical product signal from the AND circuit 142, thereby turning on all the sampling switches 151. Therefore, when the signal NRG becomes the H level, the voltage signal Vbk of the image signal line 171 are sampled into all the data lines 114, so that all the data lines Vbk (+) are precharged with the voltage Vbk (+) correspondingly to the positive wiring operation.

Next, when the flyback period is ended, the transmission start pulse DX is sequentially shifted by the shift register 141, and as shown in FIG. 5, is output as the signals S1', S2', S3', . . . , Sn' during the effective horizontal display period. The logical products of the signals S1', S2', S3', . . . , Sn' and the signal ENB are calculated by the AND circuits 142, and sampling signals S1, S2, S3, . . . , Sn, of which the pulse widths are reduced to a time period Smp such that the adjacent pulse widths do not overlap each other, are sequentially output.

On the other hand, first, the image data Vid supplied in synchronization with the horizontal scanning are distributed into six channels by the S/P conversion circuit 302 and are enhanced six times on the temporal axis. Second, the image data Vid are converted into analog signals by the D/A converter group 304, are positively rotated about the voltage Vc and are output in accordance with the positive writing operation. As a result, the image signals Vd1 to Vd6 positively rotated and output becomes a voltage higher than the voltage Vc when the pixels are set to black.

Since the signal NRG becomes an L level during the effective horizontal scan period, the selector 350 selects the image signals Vd1 to Vd6 accordingly, the signals Vid1 to Vid6 supplied to the six image signal lines 171 are the image signals Vd1 to Vd6 from the processing circuit 300.

When the sampling signal S1 becomes an H level during a period of the effective horizontal scan period when the scan signal G1 becomes an H level, the corresponding image signals Vd1 to Vd6 are sampled to the six data lines 114 belonging to the first group from the left end. The sampled image signals Vd1 to Vd6 are applied to the pixel electrodes 118 of the pixels corresponding to the intersections between the first scanning line 112 from the upper end in FIG. 2 and the six data lines 114.

Thereafter, when the sampling signal S2 becomes an active level, the image signals Vd1 to Vd6 are sampled to the six data lines 114 belonging to the second group in turn, and the image signals Vd1 to Vd6 are applied to the pixel electrodes 118 of the pixels corresponding to the intersections between the first scanning line 112 and the six data lines 114.

Similarly, when the sampling signals S3, S4, . . . , Sn sequentially become an active level, the corresponding image signals Vd1 to Vd6 are sampled into the six data lines 114 belonging to the third, fourth, . . . , n-th groups, respectively, and the image signals Vd1 to Vd6 are applied to the pixel electrodes 118 of the pixels corresponding to the intersections between the first scanning line 112 and the six data lines 114. As a result, the writing operation to all the pixels of the first row is finished.

When the scan signal G1 becomes an L level, the TFTs 116 connected to the first scanning line 112 are turned off but the voltage written to the pixel electrodes 118 is held by the storage capacitors 119 or the capacitance of the liquid crystal layer itself, so that the brightness corresponding to the held voltage is maintained.

Next, a case where the scan signal G2 becomes an active level during the effective horizontal scan period will be described. In the present embodiment, as described above, since the inversion of polarity is performed in a unit of scanning line, a negative writing operation is performed during the effective horizontal scan period. Therefore, when the signal NRG becomes an H level during the horizontal flyback period right before the scan signal G2 becomes the H level, the selector 350 selects the voltage signal Vbk. Accordingly the voltage Vbk (−) corresponding to black in a negative writing operation is applied to the six image signal lines 171. As a result, during the horizontal flyback period, all the data lines 114 are recharged with the voltage Vbk (−).

Other operations are equal to that of the time period when the scan signal G1 becomes an active level. That is, the sampling signals S1, S2, S3, . . . , Sn sequentially becomes the active level, and the writing operation to all the pixels of the second row is ended. However, the amplification and inversion circuit 306 inverts the analog signals from the D/A converter group 304 about the voltage Vc and then outputs the inverted signals correspondingly to the negative writing operations. As a result, the image signals Vd1 to Vd6 becomes a voltage lower than the voltage Vc when the pixels are set to black.

Similarly, the scan signal G3, G4, . . . , Gm become an active level, and the writing operation to the pixels of the third row, the fourth row, . . . , the m-th row is performed. That is, the positive writing operation is performed to the pixels of the odd rows, while the negative writing operation is performed to the pixels of the even rows. As a result, during one vertical scan period, the writing operation to all the pixels of the first to m-th rows is ended.

During the next vertical scan period (1F), the similar writing operation is performed, but the writing polarity to the pixels of the respective rows is inverted. That is, during the next vertical scan period, the negative writing operation is performed to the pixels of the odd rows, while the positive writing operation is performed to the pixels of the even rows. The polarity of the voltage signal Vbk is inverted in response to the inversion of the writing polarity. In this way, since the writing polarity to the pixels is changed every vertical scan period, the DC component is not applied to the liquid crystal, thereby preventing deterioration of the liquid crystal.

On the other hand, as described above, the scan signal G1 becomes an H level during the effective horizontal scan period, and becomes the H level again during the horizontal flyback period, which is after the scan signals G2, G3, and G4 sequentially become an H level during the effective horizontal scan period and right before the scan signal G5 becomes an H level during the effective horizontal scan period. That is, the scan signal G1 becomes the H level again during the horizontal flyback period after a predetermined time period passes from the time point when the image signals corresponding to the display contents are written to the pixel electrodes 118 positioned at the first scanning line 112.

During the horizontal flyback period, the voltage signal Vbk is applied to the image signal lines 171 and all the sampling switches are simultaneously turned on by the signal NRG. Therefore, the voltage signal Vbk is written to the entire pixel electrodes 118 of the pixels positioned at the first scanning line 112, so that the entire pixels of the first row are compulsorily made to display black.

Similarly, during the horizontal flyback period right before the scan signals G6, G7, G8, . . . become an H level in the effective horizontal scan period, the scan signals G2, G3, G4, . . . become an H level, so that the pixels of the second row, the third row, and the fourth row are compulsorily made to display black.

Therefore, since the pixels of the j-th row display the contents corresponding to the image signals only during the time period until the scan signal Gj becomes an H level again during the horizontal flyback period after the scan signal first becomes an H level during the effective horizontal scan period, the pixels of the respective rows all perform an impulse-type display. As a result, in the present embodiment, the residual image is prevented specifically when displaying a moving picture.

As described above, the image signals corresponding to the display state are sampled to the data lines 114 during the effective horizontal scan period. However, due to the parasitic capacitors of the data lines 114, the voltage component of the image signals remain in the data lines 114 after the effective horizontal scan period has passed. Since the residual voltage is varied depending upon the display contents, when the precharge operation is not performed during the horizontal flyback period, the data lines 114 are different in residual voltage right before the next effective horizontal scan period. That is, right before sampling the image signals, the voltages of the data lines 114 may be different from each other, depending upon the data lines 114. In this state, even when it is intended to sample the same voltage to the entire data lines in order to make the pixels of the same row to display the same brightness, the sampled voltages are different by the data lines 114 because of the different voltage states right before the sampling operation (because the charging and discharging times for reaching the voltage to the brightness are different when the image signals are sampled to the data lines 114 from the image signal lines 171), thereby deteriorating a display quality due to display blurs.

As a result, during the horizontal flyback period right before sampling the image signals corresponding to the display state, the entire data lines 114 should be precharged with a constant voltage, but in the present embodiment, the precharge operation is shared with the display erasing operation for the impulse-type display, so that complexity of the structure can be prevented.

Since the horizontal flyback period is still shorter than the effective horizontal scan period, the effective horizontal scan period is not shortened when the voltages of the image signals corresponding to the display state are written to the pixels.

Figure 6:
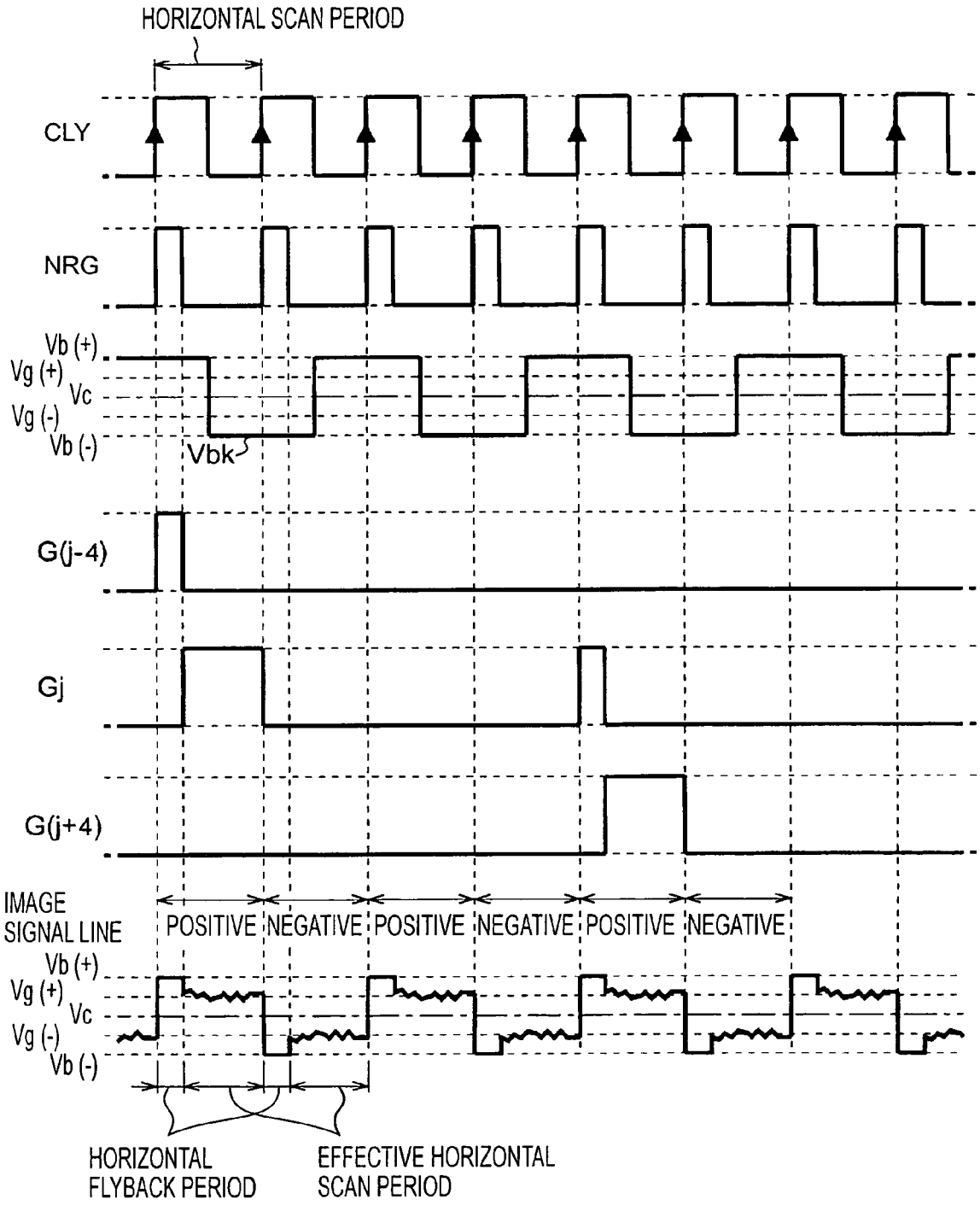
FIG. 6 is a timing chart explaining operations of the electro-optical device.

In the present embodiment, the writing polarity is inverted every scanning line and the pixels are compulsorily made to display black (erase of display) during the horizontal flyback period to correspond to the inversion of polarity. For example, as shown in FIG. 6, when the scan signal Gj becomes an H level during an effective horizontal scan period and the voltages corresponding to the display contents are written to the pixels of the j-th row with a positive polarity, the precharge operation is performed with the positive polarity right there before and the compulsory display of black during the horizontal flyback period is performed with the positive polarity.

Although not shown, when the next scan signal G(j+1) becomes an H level and the voltages corresponding to the display contents are written to the pixels of the (j+1)-th row with a negative polarity, the precharge operation is performed with the negative polarity right there before and the compulsory display of black during the horizontal flyback period is performed with the negative polarity.

That is, the precharge right before performing the writing operation correspondingly to the display contents and the compulsory display of black for erasing the display during the horizontal flyback period are all performed with the same polarity as the writing polarity corresponding to the display contents.

Here, the time required for the writing operation is considered paying attention to one pixel. When a voltage corresponding to a display content is written to the liquid crystal capacitor, a certain time period should be secured because the variation in voltage is increased due to the inversion of polarity every vertical scan period for the purpose of preventing application of DC. On the contrary, when the black voltage is written to the liquid crystal capacitor for the purpose of erasing the display, the black voltage has the same polarity as the voltage corresponding to the display content in the present embodiment, and thus the variation in voltage is small. As a result, the burden for writing the black voltage to the liquid crystal capacitor via the data lines can be reduced.

Second Embodiment

Next, an electro-optical device according to a second embodiment of the present invention will be described. Although the black-level voltage for erasing a display and the precharge voltage have been combined in the first embodiment described above, a voltage other than the black-level voltage may be preferably used. Therefore, in the second embodiment, the black display of the pixels for erasing a display and the precharge of the data lines are separately used during the horizontal flyback period.

Figure 7:
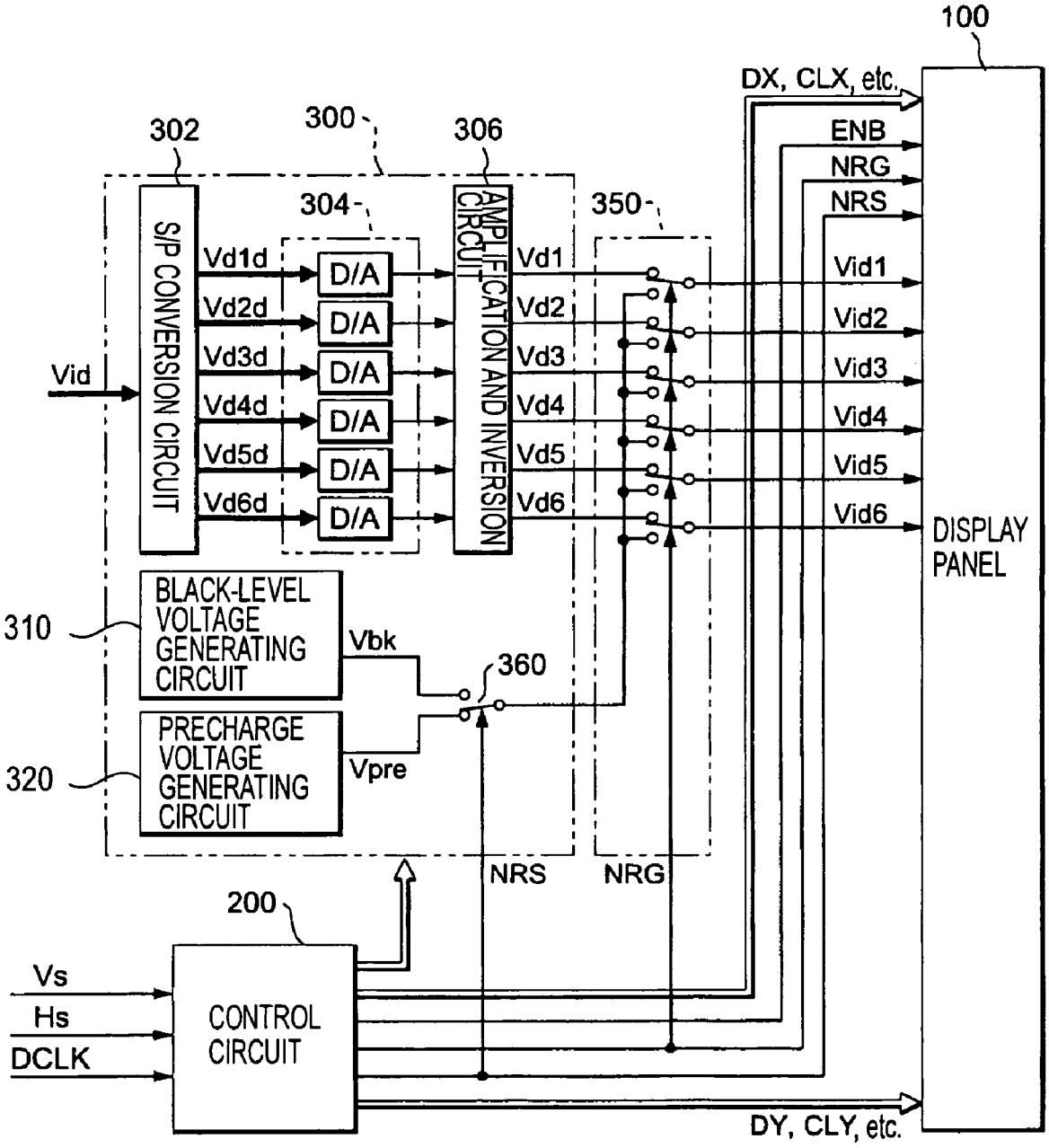
FIG. 7 is a block diagram illustrating the whole structure of an electro-optical device according to a second embodiment of the present invention.

FIG. 7 is a block diagram illustrating a structure of the electro-optical device according to the second embodiment. The electro-optical device shown in FIG. 7 has the same structure as the electro-optical device shown in FIG. 1, except that a precharge voltage generating circuit 320 and a selector 360 are further added. Therefore, in the second embodiment, the different structure therebetween will be mainly described.

In FIG. 7, the precharge voltage generating circuit 320 generates a precharge voltage signal Vpre to the data lines 114. Here, when a voltage making the pixels to display, for example, gray of an intermediate brightness between white (the highest brightness) and black (the least brightness) is used as the precharge voltage signal Vpre, as shown in FIG. 11, the precharge voltage generating circuit 320 generates a positive gray voltage Vg(+) as the precharge voltage signal Vpre during the horizontal flyback period of the horizontal scan period when the positive writing operation is performed, and generates a negative gray voltage Vg(−) as the precharge voltage signal during the horizontal flyback period of the horizontal scan period when the negative writing operation is performed.

Figure 10:
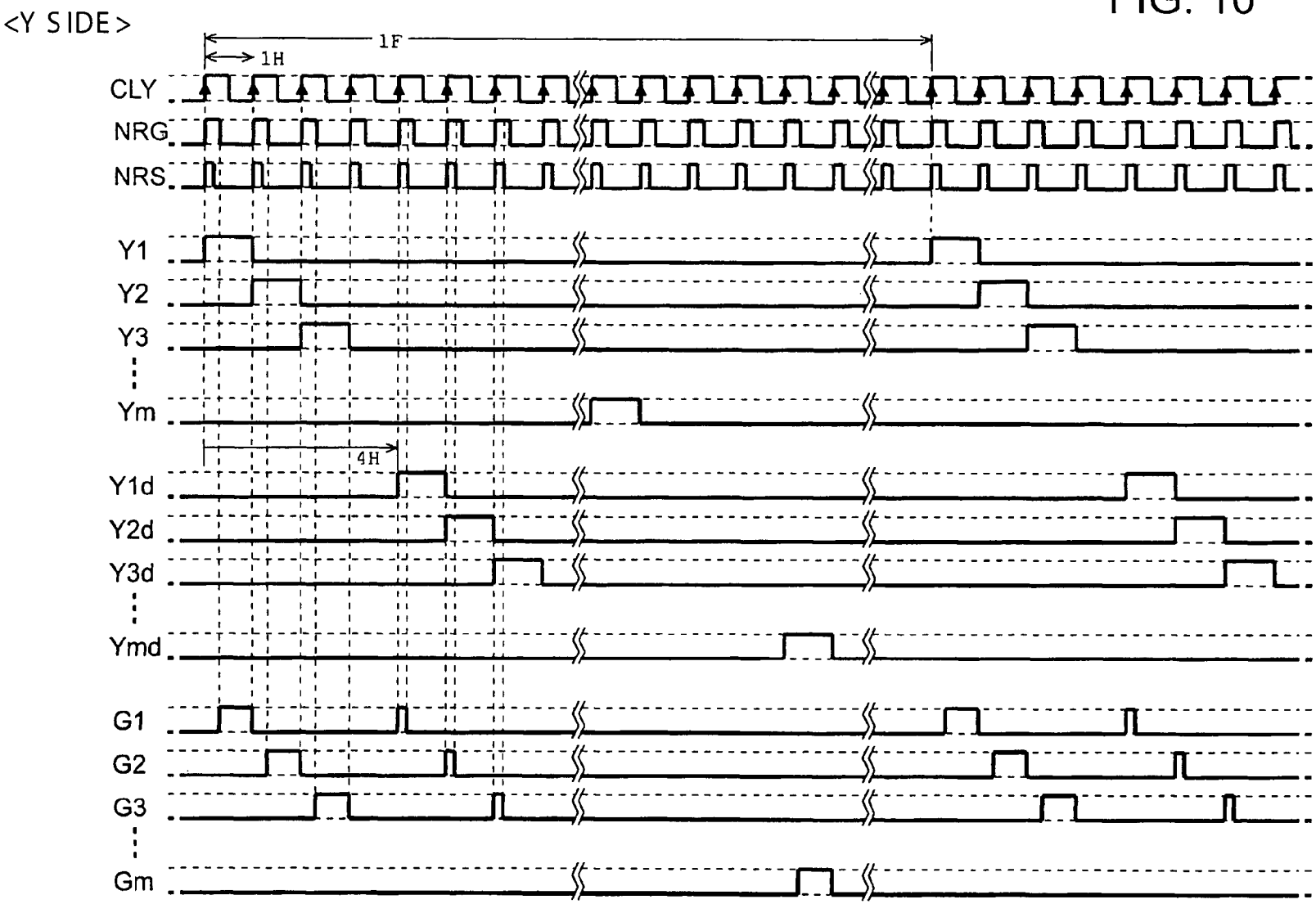
FIG. 10 is a timing chart explaining operations of the electro-optical device.

The selector 360 selects the precharge voltage signal Vpre, for example, when the signal NRG becomes an L level, selects the voltage signal Vbk when the signal NRG becomes an H level, and the selected voltage signal to one end of the input terminals of the channels in the selector 350. Here, as shown in FIG. 10 or 11, a signal NRS is a signal which is supplied from the control circuit 200 and of which the pulse duration when the signal NRS becomes an H level is reduced up to the vicinity of the leading edge.

Figure 8:
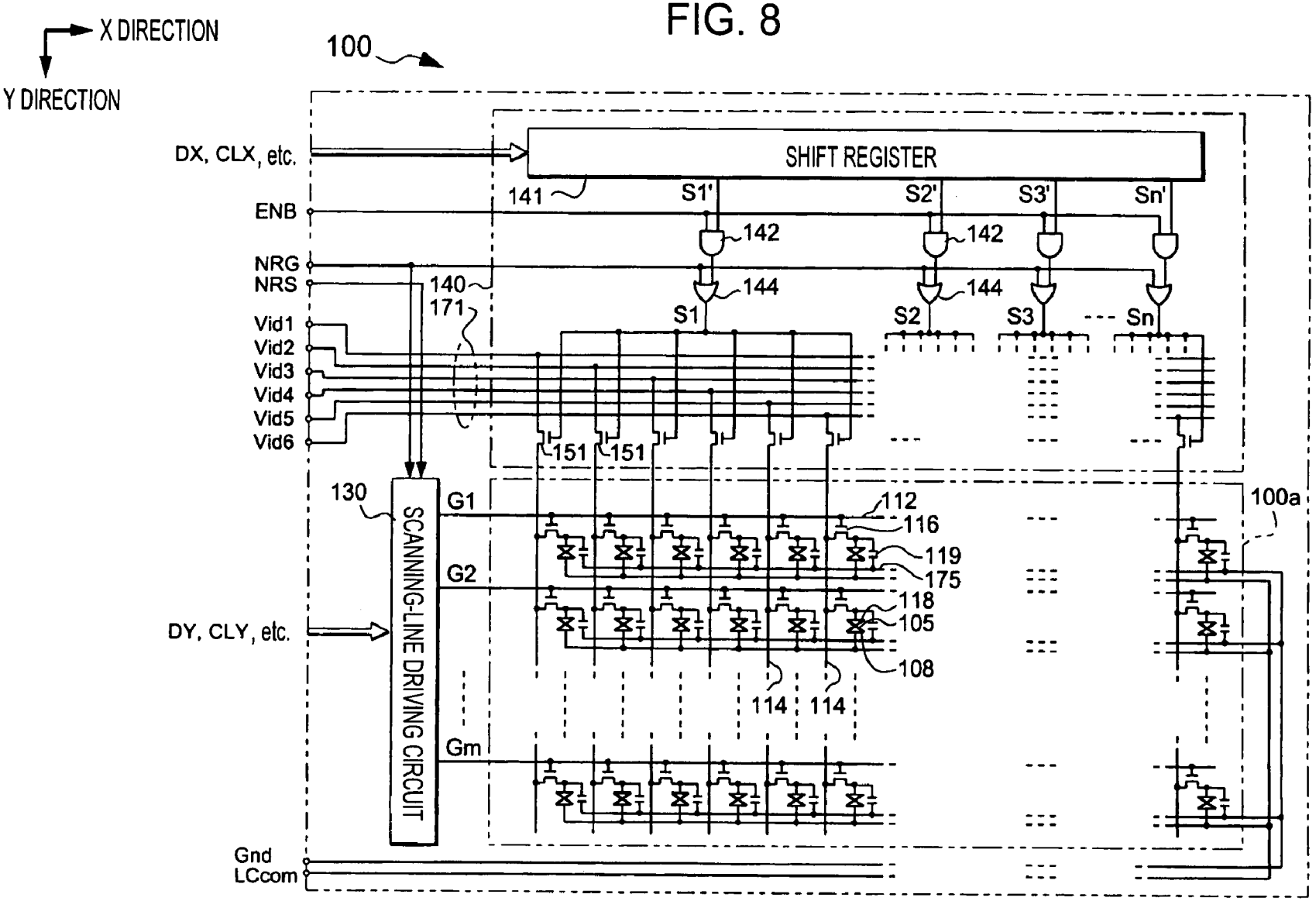
FIG. 8 is a block diagram illustrating a structure of a display panel in the electro-optical device.
Figure 9:
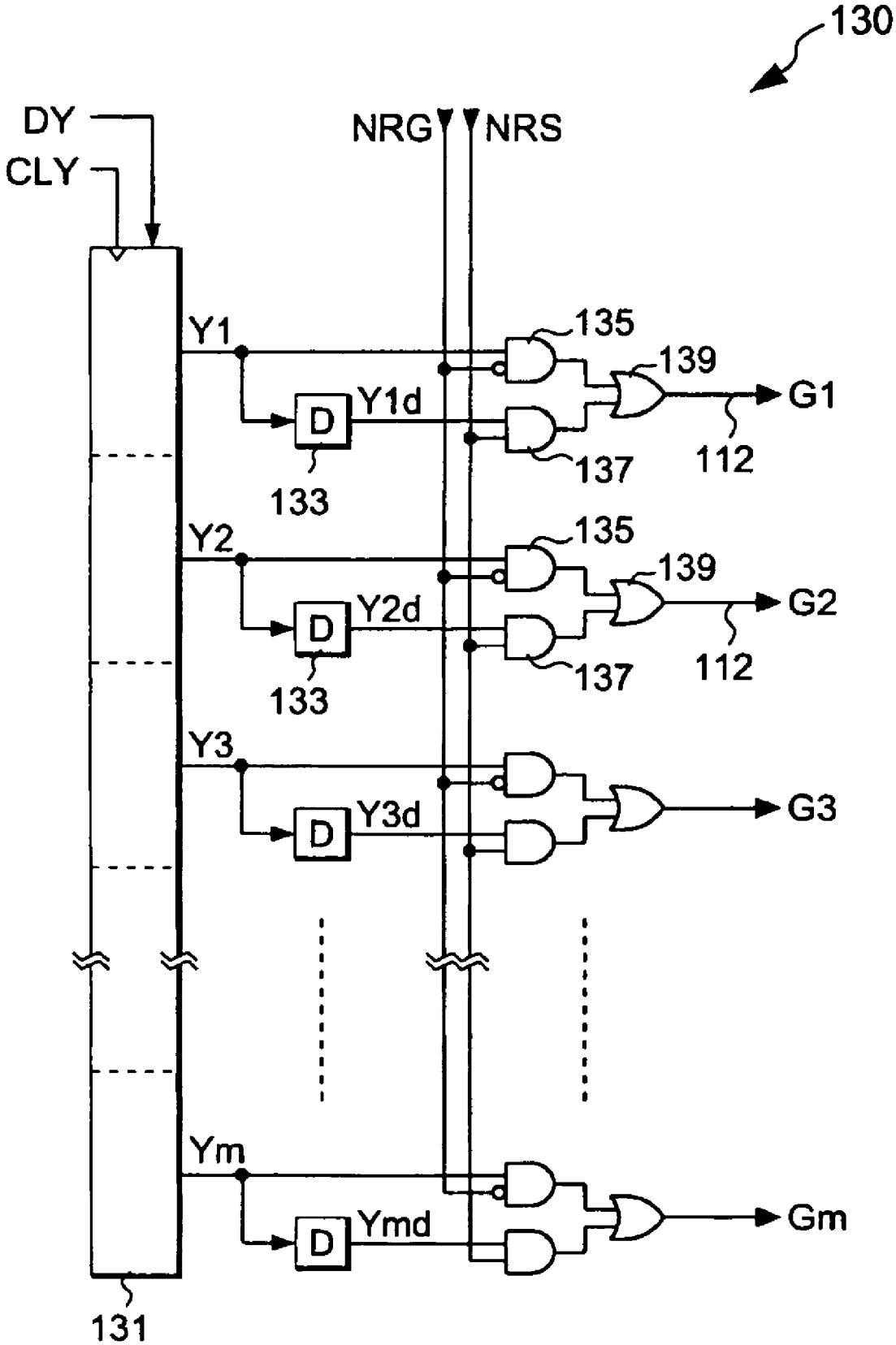
FIG. 9 is a block diagram illustrating a structure of a scanning-line driving circuit in the electro-optical device.

FIG. 8 is a block diagram illustrating a structure of the display panel of the electro-optical device according to the second embodiment. The display panel 100 shown in FIG. 8 has the same structure as the display panel shown in FIG. 2, except that the signal NRS is also supplied to the scanning-line driving circuit 130 as well as the signal NRG Specifically, in the scanning-line driving circuit 130, as shown in FIG. 9, the signal NRG is supplied to a NOT input terminal of the AND circuit 135 at each stage, and the signal NRS is supplied to the input terminal of the AND circuit 137 at each stage.

Figure 11:
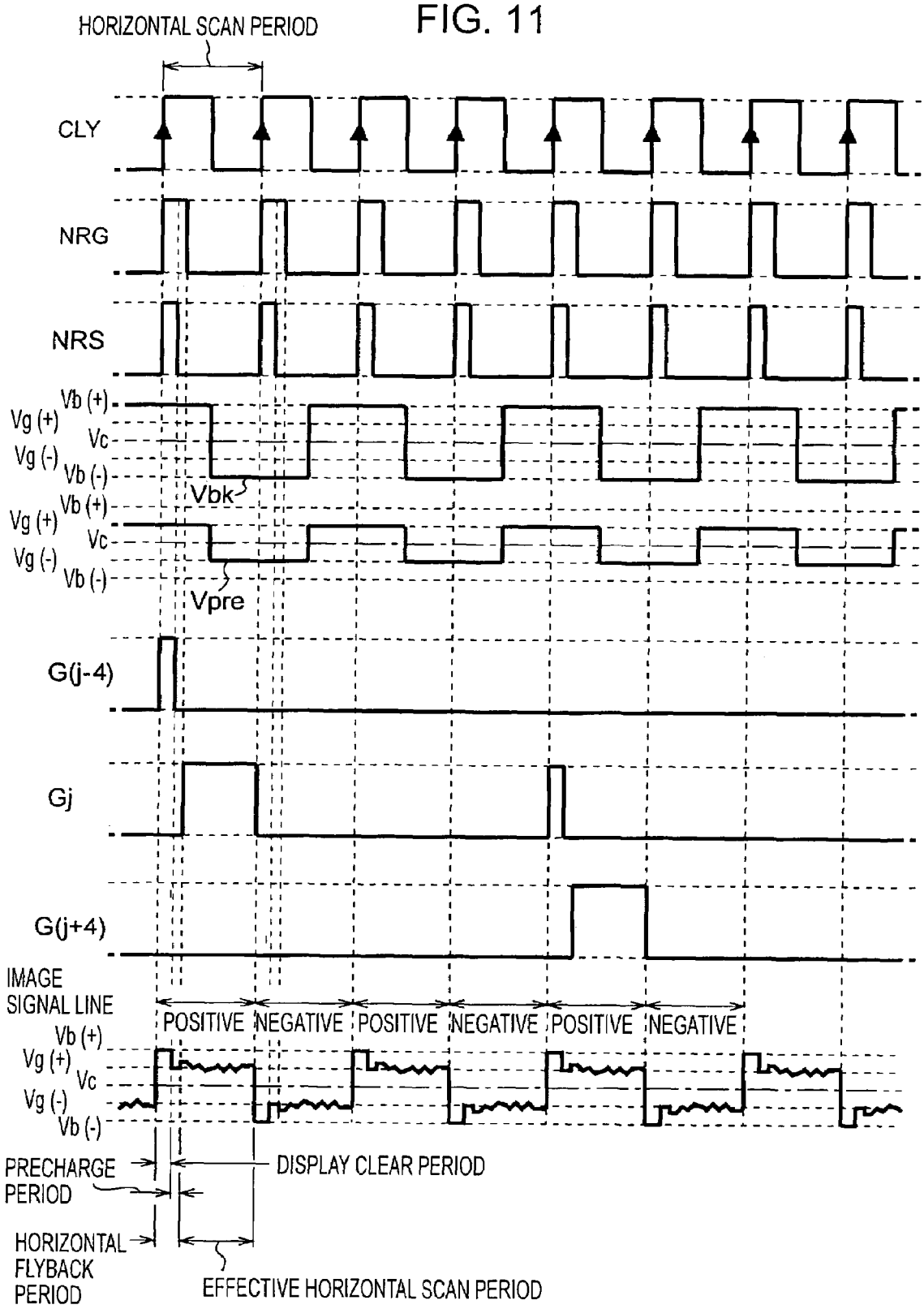
FIG. 11 is a timing chart explaining operations of the electro-optical device.

In the second embodiment, as shown in FIG. 11, a horizontal flyback period is divided into a display erasing period when both of the signals NRG and NRS are changed to the H level and a precharge period (following the horizontal flyback period) when the signals NRG and NRS are changed to the H and L levels, respectively.

In the display erasing period, since the selector 360 selects the voltage signal Vbk according to change of the level of the signal NRS into the H level and the selector 350 selects the selector 360 side according to change of the level of the signal NRG into the H level, the voltage signal Vbk is applied to six image signal lines 171. In addition, since all the sampling signals forcibly become the H levels, the voltage signal Vbk is applied to all the data lines 114. On the other hand, in the scanning-line driving circuit 130, one of scan signals becomes the H level by the logical product signal of the signal NRS and the delay signal. For this reason, all the pixels in one row corresponding to the scanning line 112 to which the scan signal having the H level is applied are erased (blackened).

Next, in the precharge period, since the selector 360 selects the precharge voltage signal Vpre according to change of the level of the signal NRS into the L level and the signal NRG is maintained in the H level, the selector 350 maintains the selection of the selector 360 side, so that the precharge voltage signal Vpre is applied to the six image signals 171. In addition, since the signal NRG is maintained in the H level, all the sampling signals forcibly become the H level, so that the precharge voltage signal Vpre is sampled from all the data lines 114.

In addition, in the precharge period, since the signals NRG and NRS are in the H and L levels, respectively, both of the AND circuits 135 and 137 of each stage are closed, so that all the scan signals become the L level. For this reason, the precharge voltage signal Vpre sampled from the data lines 114 cannot be written to the pixel.

Like this, in the precharge period, voltages of all the data lines 114 are changed from the voltage signal Vbk into the precharge voltage signal Vpre, and after that, the voltage charge state is maintained due to the parasite capacitance until the image signal is sampled according to the display content. In other words, the image signals according to the display content are sampled from all the data lines 114 in the state precharged with a voltage of the precharge voltage signal Vpre.

Like this, in the second embodiment, the precharge voltage of the data line 114 can be a voltage other than the black-level voltage for erasing display.

In addition, in the second embodiment, the precharge voltage signal may be a grey-level voltage. In addition, in positive and negative writing operations, voltage corresponding to other colors (brightness) may be used.

In the first and second embodiments, the polarity is inverted in each of the scanning lines, the delay time of the delay circuit 133 are set to the four horizontal scan periods, the scan signal Gj is changed into the H level in the effective horizontal scan period to select the scanning lines 112 of the j-th low, the three scanning liens 112 of the (j+1)-th, (j+2)-th, and (j+3)-th lows are selected, and the scan signal Gj is again changed into the H level in the horizontal flyback period just before the scan signal G(j+4) applied to the fourth scanning line 112 of the (j+4)-th low is changed into the H level. In the present invention, not limited thereto, the delay time of the delay circuit 133 may be set to even-numbered horizontal scan periods, the scan signal Gj may be changed into the H level in the effective horizontal scan period, and the scan signal Gj may be again changed into the H level in the horizontal flyback period when other even-numbered scanning lines 112 are selected.

In addition, in one vertical scan period, if screen (frame) inversion where all the pixels are written with the same polarity is employed, there is no need to limit the delay time of the delay circuit 133 to an even number.

In the first embodiment, although in the entire period of the horizontal flyback period, the signal NRG is in the H level, and the pixels for display erasing are blackened and precharged, in only some portion of the horizontal flyback period, the signal NRG may be in the H level, so that the pixels may be blackened and precharged in the some portion of the period.

Similarly, in the second embodiment, in only some portion of the horizontal flyback period, the signal NRS is in the H level, the pixels may be blackened in the some portion of the period, and just after that, the pixels may be precharged with a voltage other than the black voltage.

Figure 12:
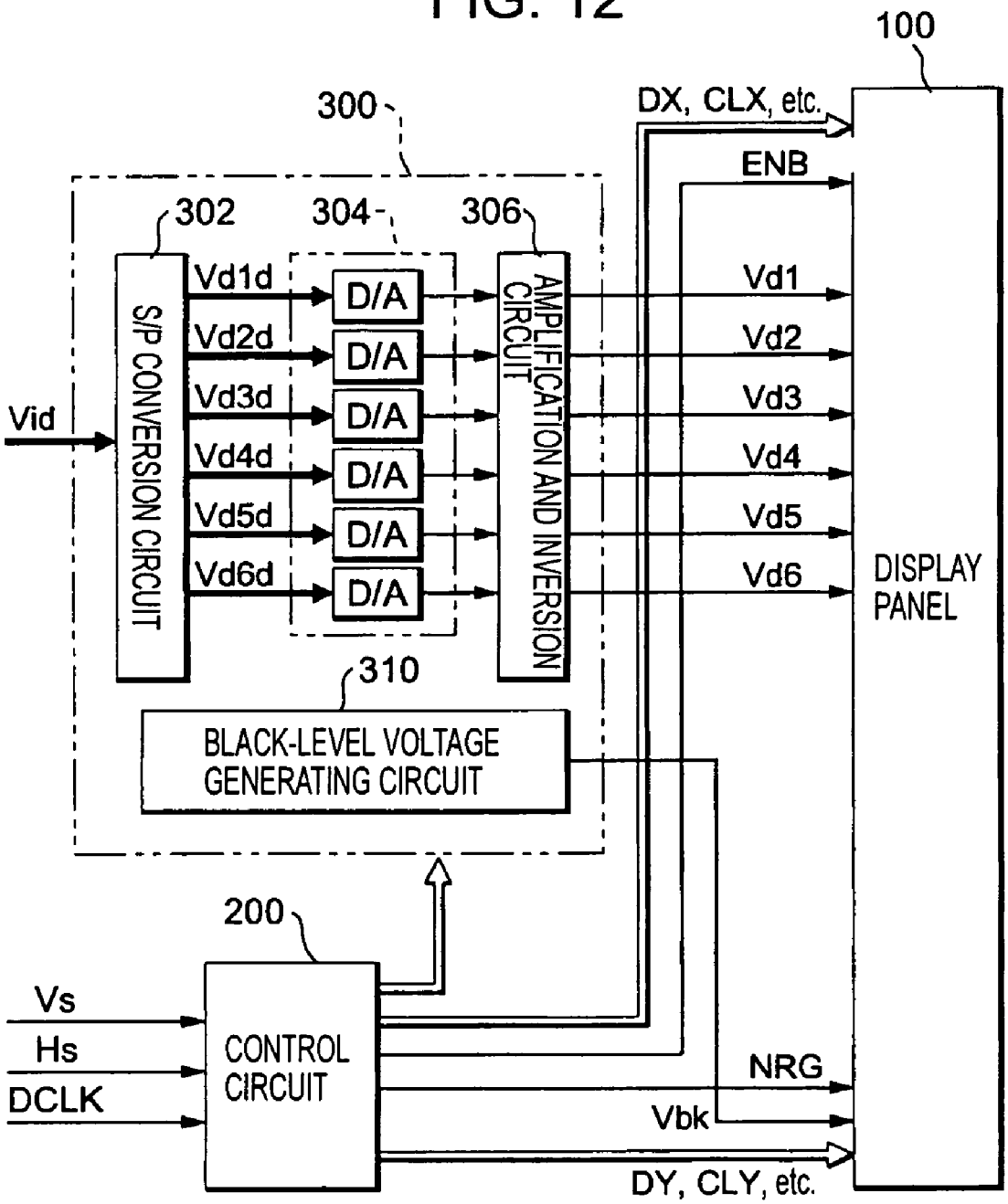
FIG. 12 is a block diagram illustrating the whole structure of an electro-optical device according to another embodiment of the present invention.
Figure 13:
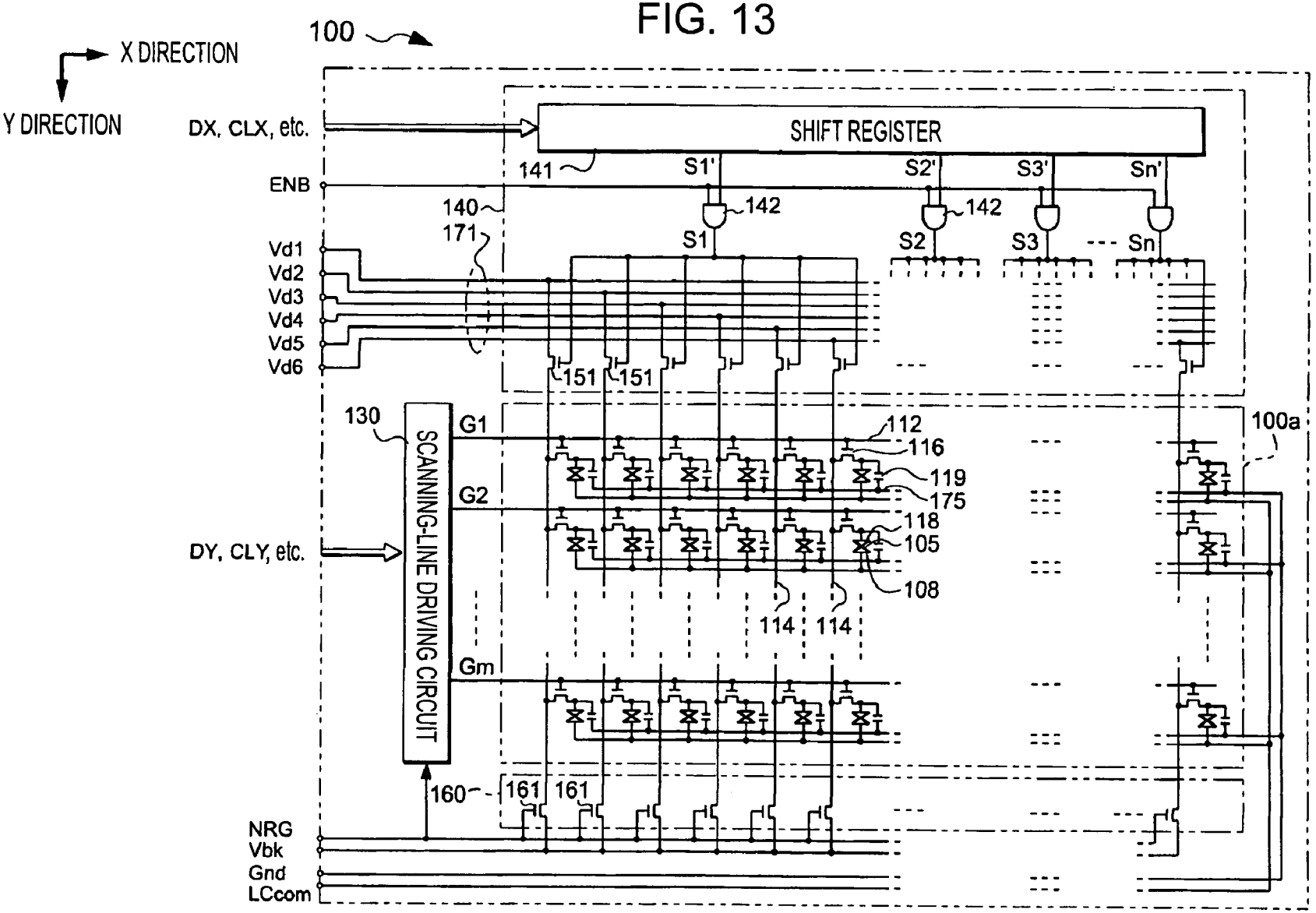
FIG. 13 is a block diagram illustrating a structure of a display panel in the electro-optical device.

In the aforementioned first embodiment, although the voltage signal Vbk is applied through the image signal line 171 in the horizontal flyback period and all the data lines 114 are sampled according to the signal NRG to construct the display erasing and precharging operations, as shown in FIG. 13, a switch 161 of turning on according to the signals NRG may be provided to one end of each data line 114, so that the voltage signal Vbk can be sampled from the entire data lines 114 without the image signal line 171. In addition, in this construction, as shown in FIG. 12, the selector 350 is unnecessary, so that the image signals Vd1 to Vd6 themselves can be applied from the inversion circuit 306 to the image signal lines 171 and the voltage signal Vbk can be applied from the black-level voltage generating circuit 310 via the switch 161 (when the switch is turned on) to the data lines 114.

In addition, in the display panel 100 (see FIG. 13) where the switch 161 is provided to one end of each data line 114, the horizontal flyback period when the switch is turned on may be divided into the display erasing period and the precharge period and the selection voltage may be applied to the scanning line 112 in the display erasing period like the second embodiment.

In the aforementioned embodiments, although the black-level voltage generating circuit 310 generates the voltage signal Vbk for blackening the pixel in the lowest brightness, the present invention is not limited thereto, but a voltage close to the black voltage may be generated to obtain the same display erasing effect.

In addition, although the black-level voltage generating circuit 310 generates analog voltages, digital voltages may be processed and then converted into the analog voltages.

Although the normally-white mode of performing the white display when the effective voltage value between the counter electrode 108 and the pixel electrodes 118 is small has been described in the aforementioned embodiment, the normally-black mode of performing the black display may be employed.

In addition, the embodiments, although the vertical scan direction is a direction G1→Gm and the horizontal scan direction is a direction S1→Sn, in case of a rotatable display panel or the below-described projector, the scan directions may be selected in a convertible manner. In addition, since the image data Vid are supplied in synchronization with the vertical and horizontal scan signals, there is no need to modify the processing circuit 300.

In the aforementioned embodiments, although the six data lines 114 are integrated into one block and the image signals Vd1 to Vd6 converted into six channels are sampled from the six data lines 114, the number of conversion operations and the number of simultaneously-applied data lines (that is, the number of data lines constituting one block) are not limited to 6. For example, if the response velocity of the sampling switch 151 is sufficiently high, the image signals may be serially transmitted to one image signal line without a parallel conversion operation, so that the data lines 114 can be sequentially sampled. In addition, the number of conversion operations and the number of simultaneously-applied data lines may be selected as "3", "12", "24", "48", etc., so that image signals converted into 3, 12, 24, 48 channels, etc., may be applied to 3, 12, 24, 48 data lines, etc. In addition, since the color image signals are constructed with three primary colors, the number of conversion is preferably a multiple of 3 in order to simplify control or circuitry, but not necessarily the multiple of 3 in a case where the present invention is simply used for an optical modulation such as the below-described projector.

In addition, in the embodiments, although a glass substrate is used as the device substrate, a mono-crystalline silicon film may be formed on an insulating substrate such as sapphire, quartz, and glass by using an SOI (Silicon On Insulator) technique, and then various devices may be formed thereon. In addition, as the device substrate, a silicon substrate may be also used, and various devices may be formed thereon. In this case, electric field effect transistors are used as various switches, so that high speed operation can be implemented. However, if the device substrate is not transparent, the pixel electrode 118 may be made of aluminum or provided with an additional reflecting layer, so that it may be used as a reflection-type one.

Moreover, in the aforementioned embodiment, a TN (Twisted Nematic) type liquid crystal is used as the liquid crystal, but a bi-stable type liquid crystal having a memory property such as a BTN (Bi-stable Twisted Nematic) ferroelectric type, a polymer distributed type liquid crystal, and a GH (Guest-Host) type liquid crystal in which dye molecules are aligned in parallel to the liquid crystal molecules by melting dye (guest), which anisotropically absorbs a visible ray in the major axis direction and the minor axis direction of the liquid crystal molecules, in a liquid crystal (host) having a constant molecule alignment may be employed.

A vertical alignment (homeotropic alignment) in which the liquid crystal molecules are aligned in a direction perpendicular to both substrates at the time of non-application of voltage and the liquid crystal molecules are aligned in a direction parallel to both substrates at the time of application of voltage may be employed. Further, a parallel (horizontal) alignment (homogeneous alignment) in which the liquid crystal molecules are aligned in a direction parallel to both substrates at the time of non-application of voltage and the liquid crystal molecules are aligned in a direction perpendicular to both substrates may be also employed. In this way, the present invention may employ various kinds of liquid crystal or alignment schemes.

Although the above description is made on an electro-optical device using liquid crystal as an electro-optical material, the present invention can be adapted to any hold-type devices for precharging data line before a writing operation, for example, devices using EL (Electronic Luminescence) elements, electrophoresis elements, digital mirror elements, and the like.

(Electronic Apparatus)

Next, several kinds of electronic apparatuses employing the electro-optical device according to the embodiments described above will be described.

(Projector)

Figure 14:
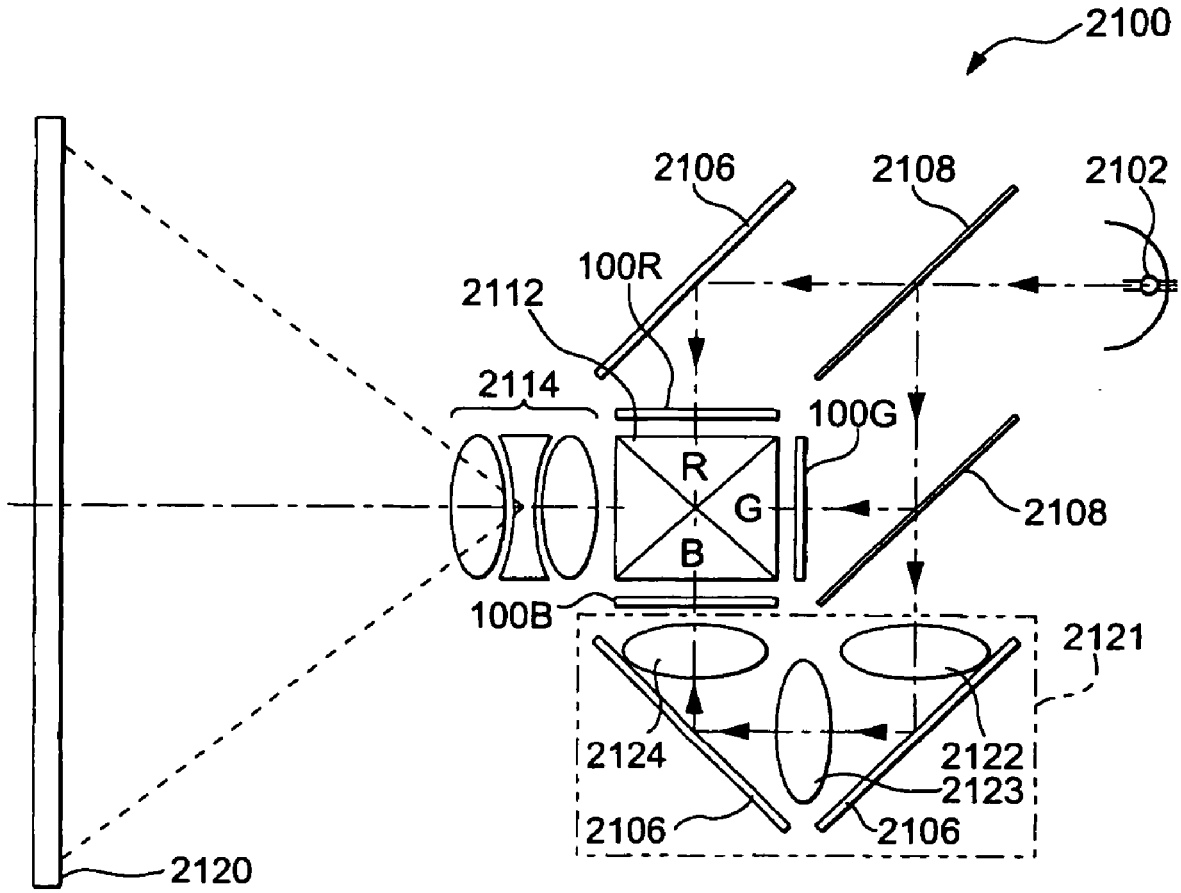
FIG. 14 is a cross-sectional view illustrating a structure of a projector as an example of an electronic apparatus to which the electro-optical device according to the embodiments is applied.

First, a projector having the aforementioned display panel 100 of the electro-optical device as light valves will be described. FIG. 14 is a plan view illustrating a structure of the projector. As shown in the figure, a lamp unit 2102 comprising a white light source such as a halogen lamp, etc. is provided inside the projector 2100. The projection light emitted from the lamp unit 2102 is separated into three primary colors of R (red color), G (green color), and B (blue color) by three mirrors 2106 and two dichroic mirrors 2108 disposed therein, and the separated light components are then guided to light valves 100R, 100Q, and 100B corresponding to the respective primary colors. Since the light component of B color has an optical path longer than those of R color or G color, the light component of B color is guided through a relay lens system 2121 including an incident lens 2122, a relay lens 2123, and an emission lens 2124 so as to prevent loss thereof.

Here, the light valves 100R, 100G, and 100B have the same structure as that of the display panel 100 according to the aforementioned embodiments, and are driven with the image signals corresponding to the respective colors R, CG and B supplied from the processing circuit (omitted in FIG. 14). That is, in the projector 2100, three display panels 100 are provided correspondingly to the respective colors R, C, and B.

The light components modulated by the light valves 100R, 100C, and 100B, respectively, are incident on the dichroic prism 2112 from three sides. In the dichroic prism 2112, the light components of R color and B color are refracted by 90°, while the light component of G color goes straightly. Therefore, the images of the respective colors are synchronized and then a color image is projected onto a screen 2120 through a projection lens 2114.

Since the light components corresponding to the respective primary colors R, C, and B are applied to the light valves 100R, 100C, and 100B through the dichroic mirror 2108, it is not necessary to provide the color filters described above. The images passing through the light valves 100R and 100B are reflected from the dichroic mirror 2112 and then projected, while the image passing through the light valve 100G is projected as it is. Therefore, the horizontal scan direction by the light valves 100R and 100B is opposite to the horizontal scan direction by the light valve 100C, and the image of which the right and left side are reversed is displayed.

(Mobile Computer)

Figure 15:
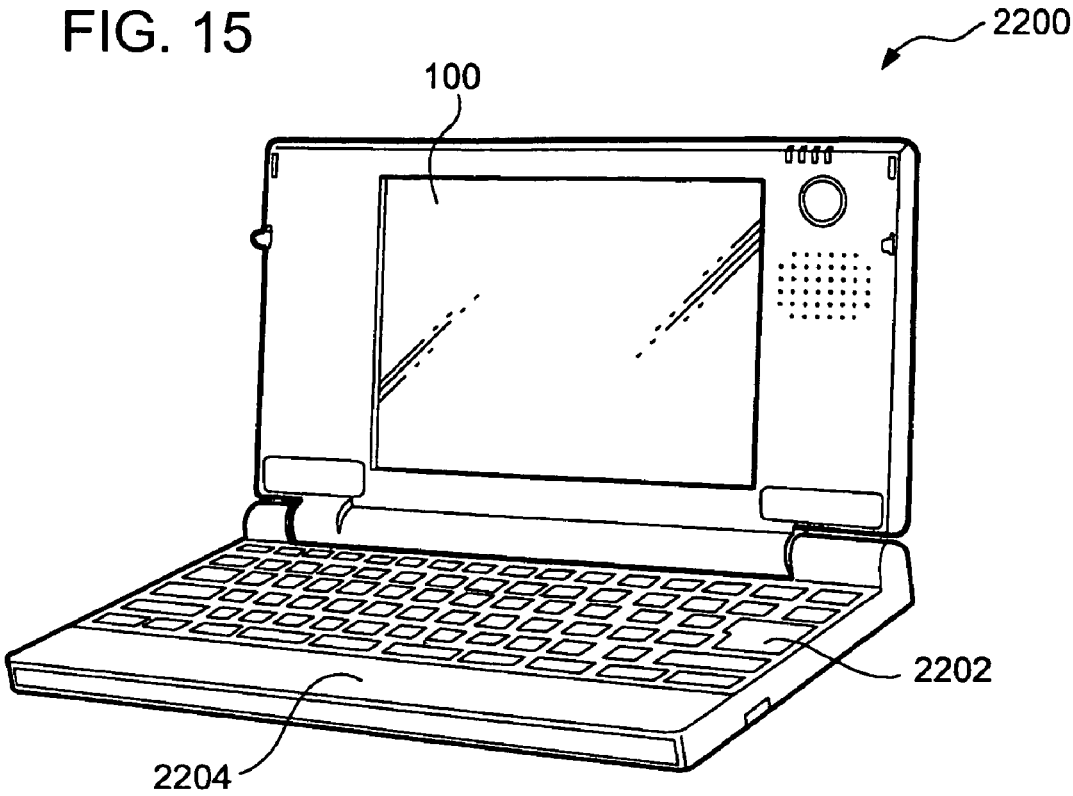
FIG. 15 is a perspective view illustrating a structure of a personal computer as an example of an electronic apparatus to which the electro-optical device according to the embodiments is applied.

Next, an example where the aforementioned display panel 100 of the electro-optical device is applied to a mobile personal computer will be described. FIG. 15 is a perspective view illustrating a structure of the personal computer. In the figure, the computer 2200 comprises a main body 2204 having a keyboard 2202 and a display panel 100 used as a display unit. The rear surface thereof is provided with a backlight unit (not shown) for enhancing visibility.

(Mobile Phone)

Figure 16:
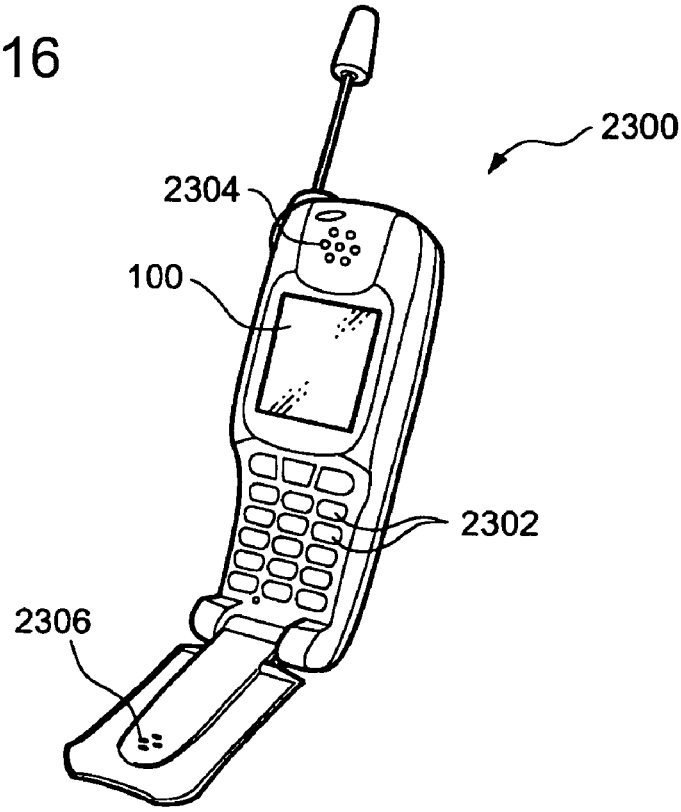
FIG. 16 is a perspective view illustrating a structure of a mobile phone as an example of an electronic apparatus to which the electro-optical device according to the embodiments is applied.

Next, an example where the aforementioned display panel 100 of the electro-optical device is applied to a display unit of a mobile phone will be described. FIG. 16 is a perspective view illustrating a structure of the mobile phone. In the figure, the mobile phone 2300 comprises a plurality of manipulation buttons 2302, a receiver 2304, a transmitter 2306, and a display panel 100 used as a display unit. The rear surface of the display panel 100 is also provided with a backlight unit (not shown) for enhancing visibility.

(Other Electronic Apparatuses)

Examples of the electronic apparatuses may include a television, a view-finder type or monitor-direct-vision type video tape recorder, a car navigation apparatus, a pager, an electronic pocket book, a calculator, a word processor, a work station, a television phone, a POS terminal, a digital still camera, an apparatus having a touch panel, and the like, in addition to the electronic apparatuses described with reference to FIGS. 14, 15, and 16. It is not to say that the electro-optical device according to the present invention can be applied to the various electronic apparatuses.

What is claimed is:

1. A driving circuit of an electro-optical device for driving pixels arranged to correspond to intersections between a plurality of scanning lines and a plurality of data lines, the driving circuit comprising:

a scanning-line driving circuit that selects a first scanning line of the plurality of scanning lines and supplies a selection signal to the first scanning line during a first effective horizontal scan period of the first horizontal scan period, and that supplies a scan signal to the first scanning line during all or a part of a horizontal flyback period after the first horizontal scan period; and a data-line driving circuit and processing circuit that, during the first effective horizontal scan period, supply the pixels corresponding to the intersections with the selected scanning line with an image signal corresponding to a brightness to be displayed and that, during a first part of the horizontal flyback period, supply the pixels with an image signal for displaying at, or nearly at, a minimum brightness, and during a second part of the horizontal flyback period, supply a data line with a precharge signal for displaying at a gray level, the gray level being an intermediate brightness between white and black, the second part of the horizontal flyback period beginning at an end of a first selection signal and ending at a beginning of a second selection signal, no selection signal being supplied by the scanning-line driving circuit while the precharge signal is supplied.

2. The driving circuit of an electro-optical device according to claim 1, wherein each pixel has a pixel electrode and a counter electrode opposing the pixel electrode, and the data-line driving circuit alternately supplies the plurality of data lines with a negative voltage lower and a positive voltage higher than a voltage supplied to the counter electrode every horizontal scan period.

3. The driving circuit of an electro-optical device according to claim 2, wherein the scanning-line driving circuit supplies a scan signal to the first scanning line during the effective horizontal scan period and then supplies again the scan signal to the first scanning line during all or a part of the horizontal flyback period right before selecting an even-numbered scanning line.

4. The driving circuit of an electro-optical device according to claim 1, wherein the data-line driving circuit has a first selector that selects and outputs any one of an image signal allowing the pixels to make a display during the effective horizontal scan period and an image signal making the pixels display the least brightness or brightness close to the least brightness during the horizontal flyback period.

5. The driving circuit of an electro-optical device according to claim 4, wherein the first selector outputs the image signal making the pixels display the least brightness or the brightness close to the least brightness in response to a selection signal which has a high level during the horizontal flyback period.

6. The driving circuit of an electro-optical device according to claim 5, wherein the selection signal of the first selector is also used as a precharge control signal to the plurality of data lines.

7. The driving circuit of an electro-optical device according to claim 1, wherein the scanning-line driving circuit has a delay circuit that delays the scan signal by the number of periods corresponding to a plurality of horizontal scan periods and that supplies the delayed scan signal to the first scanning line during all or a part of the horizontal flyback period.

8. The driving circuit of an electro-optical device according to claim 1, wherein during the horizontal flyback period, the precharge signal is supplied to the plurality of data lines, after supplying the pixels corresponding to the selected-again first scanning line with the image signal making the pixels display the least brightness or the brightness close to the least brightness.

9. The driving circuit of an electro-optical device according to claim 8, further comprising a second selector that outputs any one of the image signal making the pixels corresponding to the first scanning line selected again display the least brightness or the brightness close to the least brightness and the precharge signal to the pixels during the horizontal flyback period.

10. A driving method of an electro-optical device of driving pixels arranged to correspond to intersections between a plurality of scanning lines and a plurality of data lines, wherein a first scanning line is selected among the plurality of scanning lines and a selection signal is supplied to the first scanning line during an effective horizontal scan period of a horizontal scan period when the first scanning line is selected, a scan signal is supplied again to the first scanning line during all or a part of a horizontal flyback period of a horizontal scan period when a second scanning line is selected among the plurality of scanning lines, and the pixels corresponding to the intersections with the selected scanning line are supplied with an image signal corresponding to a brightness to be displayed during the effective horizontal scan period and are supplied, during a first part of a horizontal flyback period, with an image signal making the pixels display the least brightness or a brightness close to the least brightness, and, during a second part of a horizontal flyback period, a data line is supplied with a precharge signal for displaying at a gray level, the gray level being an intermediate brightness between white and black, the second part of the horizontal flyback period beginning at an end of a first selection signal and ending at a beginning of a second selection signal, no selection signal being supplied by the scanning-line driving circuit while the precharge signal is supplied.

11. The driving method of an electro-optical device according to claim 10, wherein during all or a part of the horizontal flyback period, the first scanning line is supplied with the scan signal, the plurality of data lines are supplied with the image signal making the pixels display the least brightness or the brightness close to the least brightness, and then the plurality of data lines are precharged with a predetermined voltage.

12. An electro-optical device comprising:

pixels that are arranged to correspond to intersections between a plurality of scanning lines and a plurality of data lines;

a scanning-line driving circuit that selects a first scanning line of the plurality of scanning lines and supplies a selection signal to the first scanning line during an effective horizontal scan period of a horizontal scan period when the first scanning line is selected, and that supplies again a scan signal to the first scanning line during all or a part of a horizontal flyback period of a horizontal scan period when a second scanning line of the plurality of scanning lines is selected; and a data-line driving circuit and a processing circuit that supply the pixels corresponding to the intersections with the selected scanning line with an image signal corresponding to a brightness to be displayed during the effective horizontal scan period and that supply the pixels, during a first part of the horizontal flyback period, with an image signal making the pixels display the least brightness or a brightness close to the least brightness, and supply a data line, during a second part of the horizontal flyback period, with a precharge signal for displaying a gray level, the gray level being an intermediate brightness between white and black, the second part of the horizontal flyback period beginning at an end of a first selection signal and ending at a beginning of a second selection signal, no selection signal being supplied by the scanning-line driving circuit while the precharge signal is supplied.

13. An electronic apparatus comprising the electro-optical device according to claim 12.

* * * * *